US006842936B2

(12) United States Patent
Policicchio et al.

(10) Patent No.: US 6,842,936 B2
(45) Date of Patent: Jan. 18, 2005

(54) ADAPTER PLATES FOR CLEANING IMPLEMENT

(75) Inventors: Nicola John Policicchio, Mason, OH (US); Philip Samuel Johnson, Wyoming, OH (US); Paul Joseph Russo, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 155 days.

(21) Appl. No.: 09/929,938

(22) Filed: Aug. 15, 2001

(65) Prior Publication Data

US 2003/0074756 A1 Apr. 24, 2003

Related U.S. Application Data

(63) Continuation-in-part of application No. 09/723,026, filed on Nov. 27, 2000, which is a continuation-in-part of application No. PCT/US99/26579, filed on Nov. 9, 1999, application No. 09/929,938, which is a continuation-in-part of application No. 09/723,025, filed on Nov. 27, 2000, which is a continuation-in-part of application No. PCT/US99/26579, application No. 09/929,938, which is a continuation-in-part of application No. 09/831,480, filed on May 9, 2001, and a continuation-in-part of application No. 09/788,761, filed on Feb. 20, 2001.

(60) Provisional application No. 60/162,935, filed on Nov. 2, 1999, provisional application No. 60/110,476, filed on Dec. 1, 1998, and provisional application No. 60/184,780, filed on Feb. 24, 2000.

(51) Int. Cl.[7] ..... A47L 13/12; A47L 13/22

(52) U.S. Cl. ..... 15/104.94; 15/231; 15/114

(58) Field of Search ..... 15/104.94, 147.2, 15/228, 231, 232; 401/136–140, 27, 282, 284, 289

(56) References Cited

U.S. PATENT DOCUMENTS

| | | | | | |
|---|---|---|---|---|---|
| 3,056,989 | A | * | 10/1962 | Murphy | 15/231 |
| 3,099,855 | A | * | 8/1963 | Nash | 15/231 |
| 3,465,377 | A | * | 9/1969 | Thomas | 15/147.1 |
| 3,792,505 | A | * | 2/1974 | Saltzstein | 15/231 |
| 3,877,103 | A | | 4/1975 | Nash | |
| 3,896,518 | A | * | 7/1975 | Von Post et al. | 15/104.94 |
| 4,750,233 | A | * | 6/1988 | Swain | 15/118 |
| 4,766,632 | A | | 8/1988 | Murray | |
| 5,419,015 | A | * | 5/1995 | Garcia | 15/228 |
| 5,888,006 | A | | 3/1999 | Ping et al. | |
| 6,061,864 | A | | 5/2000 | Ensson | |
| 6,317,917 | B1 | * | 11/2001 | Hsu | 15/228 |

FOREIGN PATENT DOCUMENTS

| | | | |
|---|---|---|---|
| DE | 200 03 733 U1 | | 6/2000 |
| JP | 11-290255 | * | 10/1999 |
| WO | WO 00/27271 | | 5/2000 |

* cited by examiner

*Primary Examiner*—Terrence R. Till
(74) *Attorney, Agent, or Firm*—Thibault Fayette; Kim W. Zerby; Steven W. Miller

(57) ABSTRACT

Adapter plates which can be used with a cleaning implement are provide. These adapter plates can be removably attached to a dry or wet cleaning implement in order to allow a consumer to use longer and/or larger sheets or pads without having to purchase a complete cleaning implement. These adapter plates may have elevational elements at the bottom surface to improve the efficiency of cleaning by creating pressure zones in the sheet or pad. These adapter plates may also have a scrubbing element secured at one edge of the plate for heavy stain removal.

38 Claims, 16 Drawing Sheets

ADAPTER PLATES FOR CLEANING IMPLEMENT

CROSS-REFERENCE TO RELATED APPLICATIONS

This application is a Continuation-in-part and claims the benefit of U.S. application Ser. No. 09/723,026, filed Nov. 27, 2000, by Nicola Policicchio which is a Continuation-in-part of International Application Ser. No. PCT/US99/26579 filed Nov. 9, 1999 (P&G case 7368+) by Policicchio et al. which claims the benefit of U.S. Provisional Application Ser. No. 60/162,935 filed Nov. 2, 1999 by Policicchio et al and U.S. Provisional Application Ser. No. 60/110,476 filed Dec. 1, 1998 by Policicchio et al. This application is also a Continuation-in-part and claims the benefit of U.S. application Ser. No. 09/723,025, filed Nov. 27, 2000, by Nicola Policicchio which is a Continuation-in-part of International Application Ser. No. PCT/US99/26579 filed Nov. 9, 1999 (P&G case 7368+) by Policicchio et al. This application is also a Continuation-in-part and claims the benefit of U.S. application Ser. No. 09/831,480, filed May 9, 2001, by Policicchio at al. This application is also a Continuation-in-part and claims the benefit of U.S. application Ser. No. 09/788,761, filed Feb. 20, 2001 by Willman at al. and U.S. Provisional Application Ser. No. 60/184,780 filed Feb. 24, 2000 to Willman et al (P&G case 7973P).

All the foregoing and all the following patent applications are hereby incorporated by reference: U.S. application Ser. No. 09/188,604 filed Nov. 9, 1998 by Nagel et al. (P&G Case 7337); U.S. application Ser. No. 09/201,618 filed Nov. 30, 1998 by Benecke (P&G Case 7361); and U.S. Provisional Application Ser. No. 60/156,286 filed Sep. 27, 1999 by Sherry at al. (P&G Case 7803P).

TECHNICAL FIELD

The present invention relates to adapters for cleaning implements used with cleaning sheets or pads particularly suitable for removal and entrapment of dust, lint, hair, food crumbs, grass and the like.

BACKGROUND OF THE INVENTION

The use of cleaning implements such as mops for cleaning hard surfaces is known in the art. Modern mops typically comprise a handle connected to a mop head, which engages a disposable cleaning sheet, and the user then wipes the cleaning sheet against the surface to be cleaned. Those mops have typically a flat surface at the bottom, they have fixed dimensions and they are "specialized" in the sense that they can only be used for certain tasks such as wet cleaning or dry cleaning. Depending on the kind of cleaning that is wanted, a user is often obliged to possess mops of different sizes that can be used with different sets of sheets, and/or mops that can be used for wet or dry cleaning. It is therefore one object of this invention to provide accessories to be used with existing mop implements that will allow the user to perform the desired cleaning tasks without the burden of having to possess several implements.

SUMMARY OF THE INVENTION

An adapter plate that can be used with a cleaning implement is provided. The adapter plate has a top and a bottom surface, a leading and a trailing edge, and can be removably attached to the mop head of a cleaning implement. The adapter plate also includes securing elements which are used to removably attach a cleaning pad or a cleaning sheet.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENTS

Definitions

Figure 1:
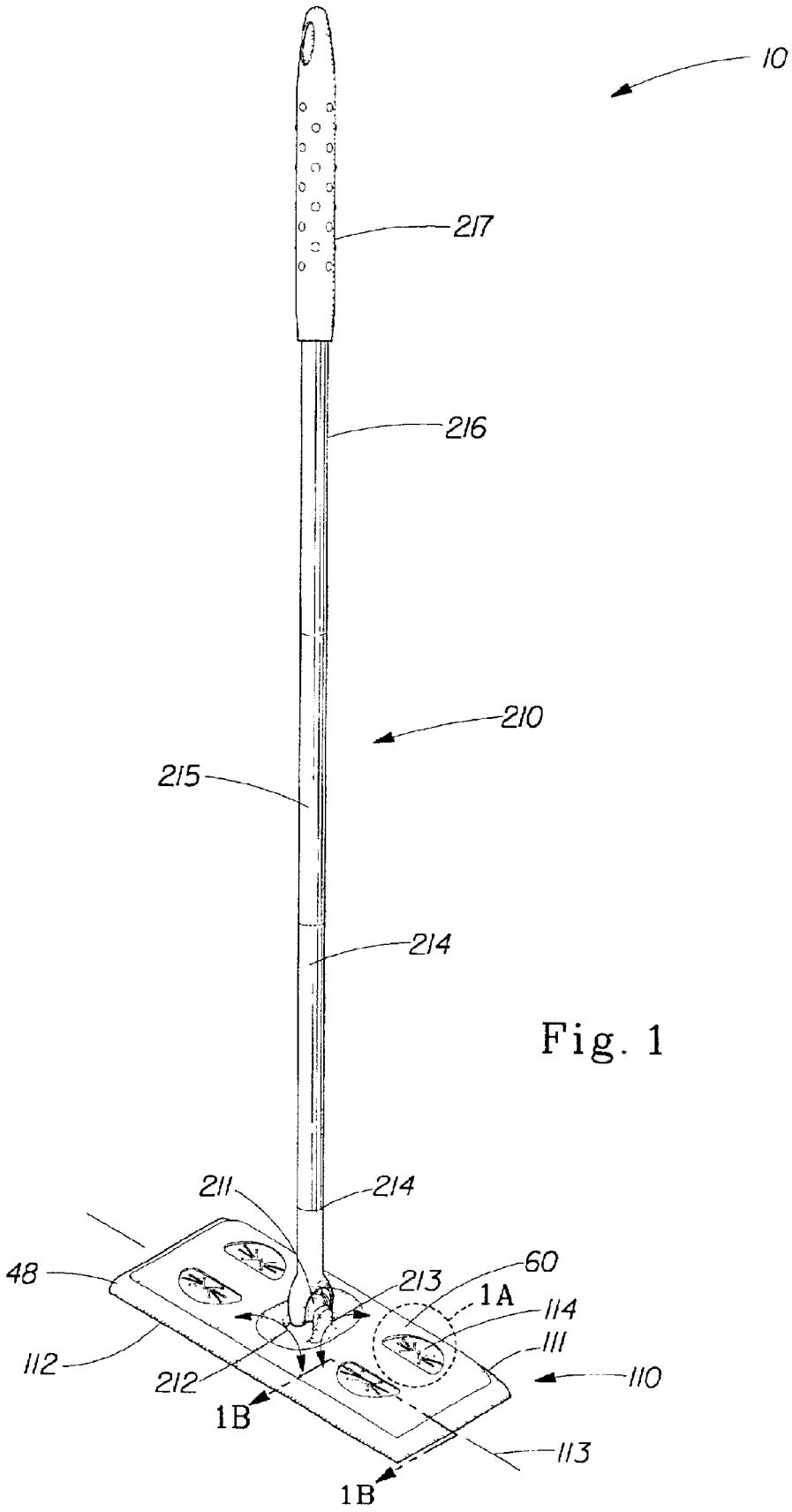
FIG. 1 is a perspective view of a preferred floor mop for dry cleaning made in accordance with the present invention.

As used herein, the term "comprising" means that the various components, ingredients, or steps, can be conjointly employed in practicing the present invention. Accordingly, the term "comprising" encompasses the more restrictive terms "consisting essentially of" and "consisting of."

As used herein, the term "direct fluid communication" means that fluid can transfer readily between two cleaning pad components or layers (e.g., the scrubbing layer and the absorbent layer) without substantial accumulation, transport, or restriction by an interposed layer. For example, tissues, nonwoven webs, construction adhesives, and the like can be present between the two distinct components while maintaining "direct fluid communication", as long as they do not substantially impede or restrict fluid as it passes from one component or layer to another.

As used herein, the term "macroscopically expanded", when used to describe three-dimensional plastic webs, ribbons, and films, refers to webs, ribbons, and films which have been caused to conform to the surface of a three-dimensional forming structure so that both surfaces thereof exhibit the three-dimensional pattern of said forming structure, said pattern being readily visible to the naked eye when the perpendicular distance between the viewer's eye and the plane of the web is about 12 inches. Such macroscopically expanded webs, ribbons and films are typically caused to conform to the surface of said forming structures by embossing, i.e., when the forming structure exhibits a pattern comprised primarily of male projections, by debossing, i.e., when the forming structure exhibits a pattern comprised primarily of female capillary networks, or by extrusion of a resinous melt directly onto the surface of a forming structure of either type. By way of contrast, the term "planar", when utilized herein to describe plastic webs, ribbons and films, refers to the overall condition of the web, ribbon or film when viewed by the naked eye on a macroscopic scale. In this context, "planar" webs, ribbons and films can include webs, ribbons and films having fine scale surface aberrations on one or both sides, said surface aberrations not being readily visible to the naked eye when the perpendicular distance between the viewer's eye and the plane of the web is about 12 inches or greater.

As used herein, the term "z-dimension" refers to the dimension orthogonal to the length and width of the cleaning pad of the present invention, or a component thereof. The z-dimension therefore corresponds to the thickness of the cleaning pad or a pad component.

As used herein, the term "x-y dimension" refers to the plane orthogonal to the thickness of the cleaning pad, or a component thereof. The x and y dimensions correspond to the length and width, respectively, of the cleaning pad or a pad component. In general, when the cleaning pad is used in conjunction with a handle, the implement will be moved in a direction parallel to the y-dimension (or width) of the pad. Of course, the present invention is not limited to cleaning pads having four sides. Other shapes, such as circular, elliptical, and the like, can also be used. When determining the width of the pad at any point in the z-dimension, it is understood that the pad is assessed according to its intended use.

As used herein, the term "layer" refers to a member or component of a cleaning pad whose primary dimension is x-y, i.e., along its length and width. It should be understood that the term layer is not necessarily limited to single layers or sheets of material. Thus a layer can comprise laminates or combinations of several sheets or webs of the requisite type of materials. Accordingly, the term "layer" includes the terms "layers" and "layered."

As used herein, the term "hydrophilic" is used to refer to surfaces that are wettable by aqueous fluids deposited thereon. Hydrophilicity and wettability are typically defined in terms of contact angle and the surface tension of the fluids and solid surfaces involved. This is discussed in detail in the American Chemical Society publication entitled *Contact Angle, Wettability and Adhesion,* edited by Robert F. Gould (Copyright 1964), which is hereby incorporated herein by reference. A surface is said to be wetted by a fluid (i.e., hydrophilic) when either the contact angle between the fluid and the surface is less than 90°, or when the fluid tends to spread spontaneously across the surface, both conditions normally co-existing. Conversely, a surface is considered to be "hydrophobic" if the contact angle is greater than 90° and the fluid does not spread spontaneously across the surface.

As used herein, the term "scrim" means any durable material that provides texture to the surface-contacting side of the cleaning pad's scrubbing layer, and also has a sufficient degree of openness to allow the requisite movement of fluid to the absorbent layer of the cleaning pad. Suitable materials include materials that have a continuous, open structure, such as synthetic and wire mesh screens. The open areas of these materials can be readily controlled by varying the number of interconnected strands that comprise the mesh, by controlling the thickness of those interconnected strands, etc. Other suitable materials include those where texture is provided by a discontinuous pattern printed on a substrate. In this aspect, a durable material (e.g., a synthetic) can be printed on a substrate in a continuous or discontinuous pattern, such as individual dots and/or lines, to provide the requisite texture. Similarly, the continuous or discontinuous pattern can be printed onto a release material that will then act as the scrim. These patterns can be repeating or they can be random. It will be understood that one or more of the approaches described for providing the desired texture can be combined to form the optional scrim material. The z direction height and open area of the scrim and or scrubbing substrate layer help to control and or retard the flow of liquid into the absorbent core material. The z height of the scrim and or scrubbing substrate help provide a means of controlling the volume of liquid in contact with the cleaning surface while at the same time controlling the rate of liquid absorption, fluid communication into the absorption core material.

For purposes of the present invention, an "upper" layer of a cleaning pad is a layer that is relatively further away from the surface that is to be cleaned (i.e., in the implement context, relatively closer to the implement handle during use). The term "lower" layer conversely means a layer of a cleaning pad that is relatively closer to the surface that is to be cleaned (i.e., in the implement context, relatively further away from the implement handle during use). As such, the scrubbing layer is preferably the lower-most layer and the absorbent layer is preferably an upper layer relative to the scrubbing layer. The terms "upper" and "lower" are similarly used when referring to pads that are multi-ply (e.g., when the scrubbing layer is a two-ply material). In terms of sequential ordering of layers (e.g., first layer, second layer, and third layer), a first layer is a "lower" layer relative to a second layer. Conversely, a third layer is an "upper" layer relative to a second layer. The terms "above" and "below" are used to describe relative locations of two or more materials in a cleaning pad's thickness. By way of illustration, material A is "above" material B if material B is positioned closer to the scrubbing layer than material A. Similarly, material B is "below" material A in this illustration.

All of the documents and references referred to herein are incorporated by reference, unless otherwise specified. All parts, ratios, and percentages herein, in the Specification, Examples, and Claims, are by weight and all numerical limits are used with the normal degree of accuracy afforded by the art, unless otherwise specified.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements.

While the present invention is discussed herein with respect to a dry or wet cleaning mop for purposes of simplicity and clarity, it will be understood that the present invention can be used with other types of mops and cleaning implements which are used with a cleaning sheet or pad releasably secured there about.

Figure 1A:
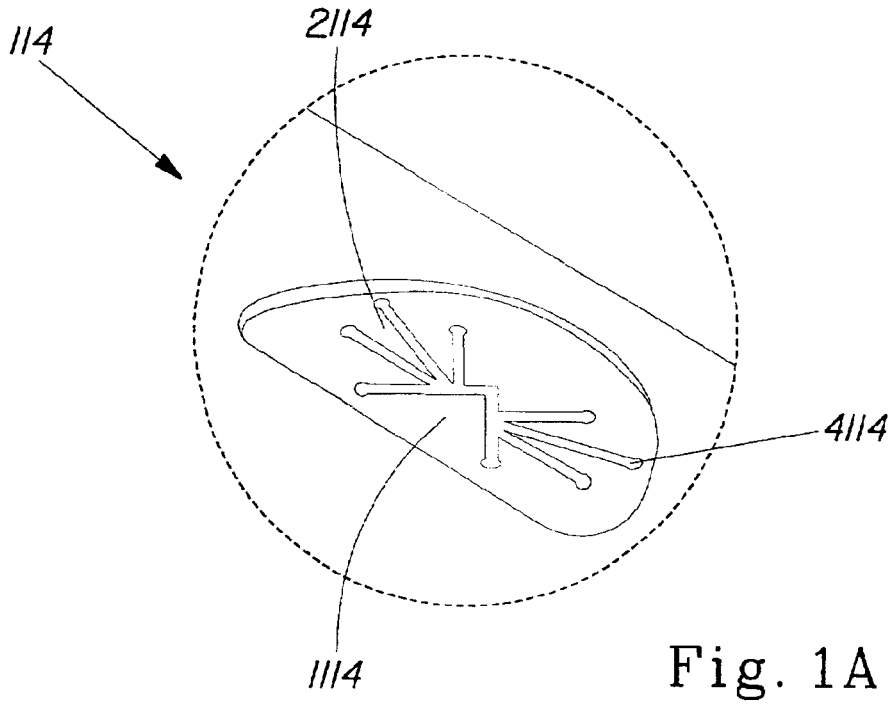
FIG. 1A is a top view of an attachment structure capable of retaining a cleaning pad or sheet made in accordance with the present invention.
Figure 1B:
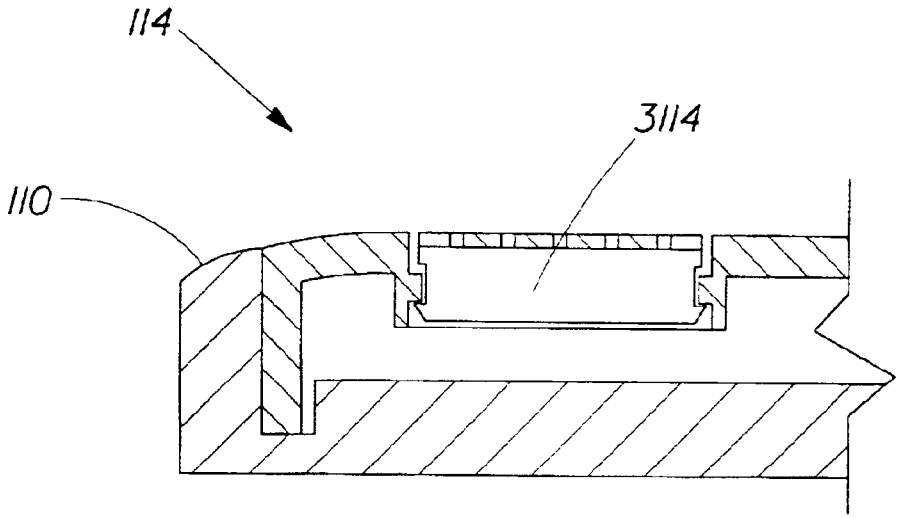
FIG. 1B is a cross-section of an attachment structure included in a mop head.
Figure 2:
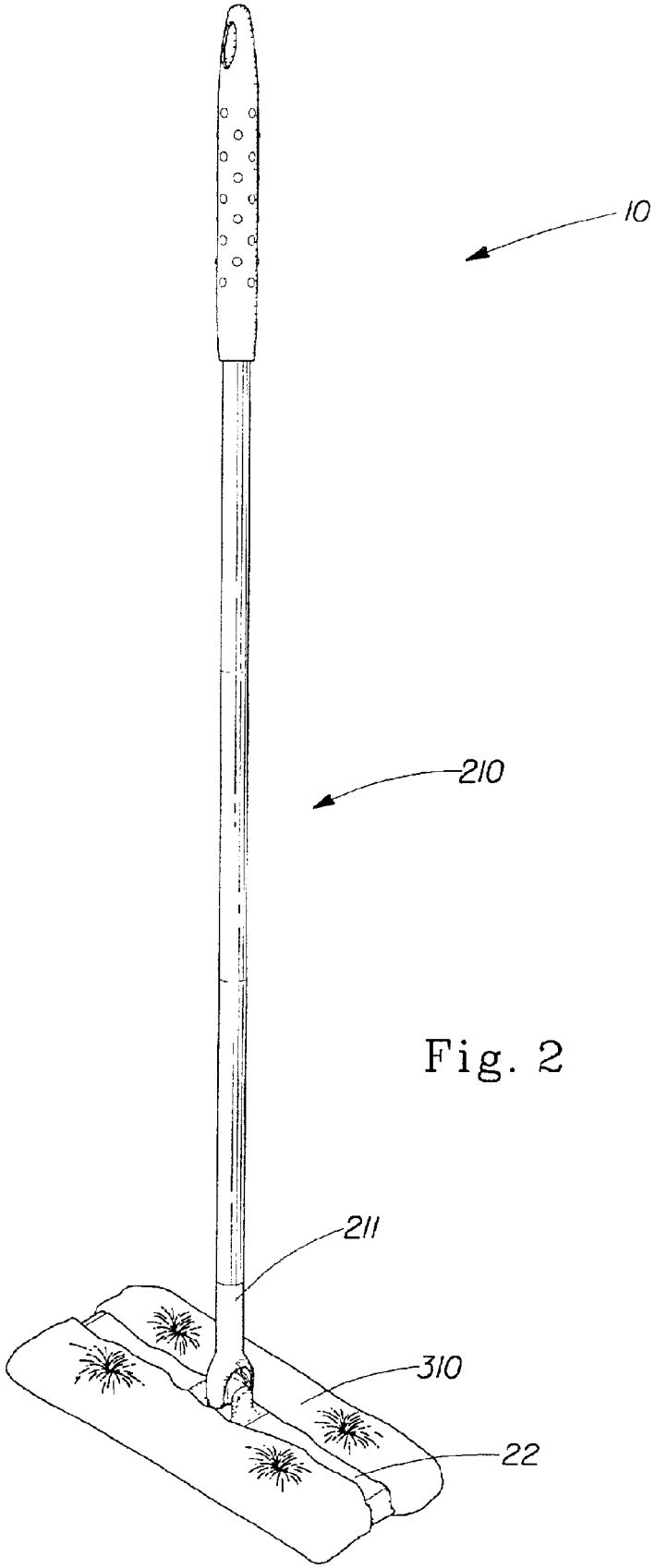
FIG. 2 is a perspective view of the floor mop of FIG. 1, wherein a sheet is attached to the mop head.

Referring to FIGS. 1 and 2, a typical dry cleaning floor mop 10 which can be used with the present invention is illustrated. The floor mop 10 comprises a mop head 110 having a leading edge 111 and a trailing edge 112 and a handle member 210. As used herein, the term "leading edge" is intended to refer to the furthest edge of the mop head 110 which leads the mop head 110 when it is moved in a forward direction away from its user. Likewise, the term "trailing edge" 112 is intended to refer to the furthest edge of the mop head 110 which trails the mop head 110 when it is moved in a forward direction away from its user. For most floor mops, the leading edge 111 and the trailing edge 112 are substantially parallel to the longitudinal axis 113 (or x dimension) of the mop head 110, as shown in FIG. 1, wherein the longitudinal axis 113 is the aids along the length of the mop head 110. A pivotable joint, such as the universal joint 211, interconnects the handle 210 of the mop 10 with the mop head 110. The universal joint 211 comprises two rotational axes that allow the handle 210 to pivot in directions 212 and 213. The handle 210 is threadably interconnected with the universal joint 211 at the connection 214. The handle 210 can be provided as a unitary structure or can comprise three sections 214, 215, and 216 which are threadedly interconnected with each other so that the floor mop 10 can be shipped within a carton of convenient size and later assembled for use. The handle section 216 can be provided with an elastic and resilient portion 217 suitable for gripping by a user of the floor mop 10. The mop head 110 also comprises a plurality of securing elements 114. The securing elements 114 are configured to receive and retain a cleaning sheet or pad 310 about the mop head 210, as shown in FIG. 2, during use. Four securing elements 310 are preferably disposed at the corners of the mop head 110, although the number and the location of these securing elements can be varied depending upon the size and shape of the mop head 110. The securing elements 114, one of which is represented with greater details in FIGS. 1A and 1B, are preferably provided in the form of an attachment structure which is described in copending U.S. application Ser. No. 09/364,714, filed Aug. 13, 1999, to Kingry, et al., now U.S. Pat. No. 6,305,046 issued Oct. 23, 2001, which is hereby fully incorporated herein by reference. One skilled in the art will understand that other kinds of securing elements may be used and provide the same benefits. Preferably, an attachment structure comprises a base triangle 1114 which is defined along two sides thereof by slits which extend through a flexible material which tones the attachment structure. The apex of the base triangle formed by the intersection of the slits is preferably disposed adjacent a side of the mop head 110, although the apex of the base triangle can be disposed adjacent the longitudinal axis of the mop head. The attachment structure also preferably comprises a plurality of pie-shaped sections 2114 having apexes which meet at a substantially common point. The pie-shaped sections are defined along two sides thereof by slits which extend through the flexible material from which the attachment structure is formed. This arrangement permits the pie-shaped sections 2114 to individually deflect relative to each other. The common point is preferably disposed adjacent the slits defining the base triangle. The slits through the flexible material of the attachment structure 114 allow the pie-shaped sections 2114 and the base triangle 1114 to deflect under finger pressure so that a portion of the sheet can be pushed through the top surface or the attachment structure and into a cavity 3114 formed within the attachment structure. As the sheet is pushed past the top surface of an attachment structure, the apexes of the pie-shaped sections and the apex of the base triangle can pierce and engage the sheet such that the sheet is retained about the mop head during use. The ends of the slits which define the base triangle and each of the pie-shaped sections preferably terminate with a substantially circular opening 4114. The circular openings can prevent stress cracking, which can be caused by repeated defections of the attachment structure's flexible material at the slit terminations of the pie-shaped sections and the base triangle during use.

Figure 3:
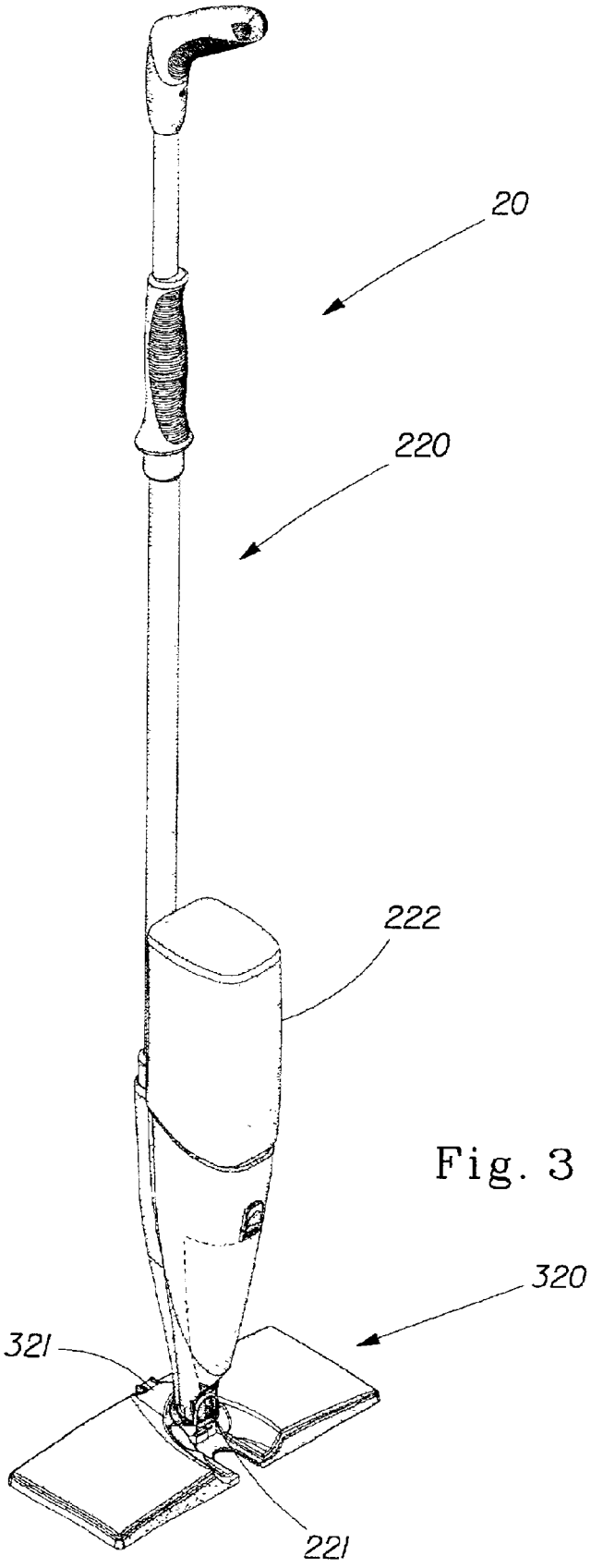
FIG. 3 is a perspective view of a preferred floor mop for wet cleaning made in accordance with the present invention.
Figure 3A:
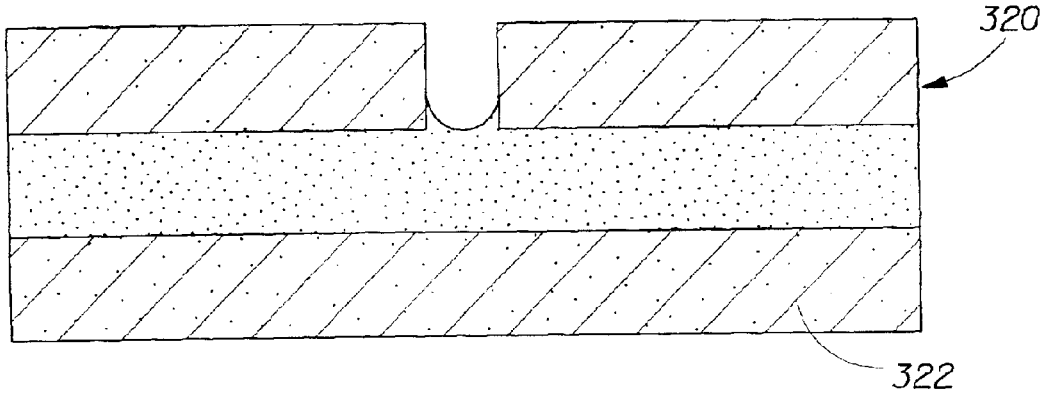
FIG. 3*a* is a bottom view of the preferred wet cleaning mop of FIG. 3*a;*

Without the adapter plate of the present invention, a floor mop 10 is usually used in combination with a disposable cleaning sheet 310 which is releasably attached to the mop head 110 using for example slitted attachment structures 114 as represented in FIG. 2. Referring to FIG. 3 and in accordance with one aspect of the present invention, a typical wet cleaning mop is represented. The wet cleaning mop 20 comprises a handle 220, a support head or mop head 320 attached to the handle by a universal joint 221, and a container 222 in fluid communication with a liquid delivery system (not represented in the Figure) which includes at least a spray nozzle 321 preferably attached to the mop head 320. Such an arrangement is described in U.S. Pat. No. 5,888,006 to Ping, et al., issued Mar. 30, 1999, the substance of which is fully incorporated herein by reference. Without the adapter plate of the present invention, a wet cleaning mop 20 is usually used in combination with an absorbent cleaning pad, preferably disposable, such as for example one described previously and which is releasably attached to the mop head 320 using Velcro® loops provided on the top surface of the pad and capable of engaging Velcro® hooks 322 provided on the bottom surface of the mop head. One skilled in the art will understand that Velcro® loops are considered to be female fasteners and Velcro® hooks are considered to be male fasteners.

As discussed more fully hereafter, one aspect of the present invention is directed to adapter plates (which in one of the embodiments can be considered to be a "dry dusting plate") which allow a wet mop to be used with dry dusting or sweeping sheets. The benefits of performing dry cleaning followed by wet cleaning have been discussed in previously filed International Application Serial No. PCT/US99/26579 filed Nov. 9, 1999 by, Policicchio, et al, incorporated herein by reference. It has been found that when an efficient sweeping/dry mopping with dry dusting sheets is done prior to wet mopping, the end result is substantially improved compared to any of those operations done alone. It has also been found that when the wet mopping operation is done using a disposable absorbent pad, the benefits are magnified. It has been found that by reducing the particulate load on the floor with an efficient dry sweeping/mopping operation, the burden put on the pad is decreased and as a result its potential efficiency and "life expectancy" measured by the total surface which can be cleaned with a single pad is increased. However, despite the greater benefits provided by a dry cleaning followed by a wet cleaning, some consumers may find it inconvenient to have multiple implements in their household due to limited storage availability, multiple handling and cost. This concern of having two different implements can be addressed by either creating a disposable wet mopping pad with attachment flaps that allow it to be secured to the attachment structures of an existing dry dusting implement such as the SWIFFER® cleaning implement (for dust cleaning) or by adding attachment structures such as grippers to the top of a WET JET® like implement (for wet cleaning) which uses Velcro® hooks at the bottom of the mop head capable of engaging the Velcro® loops on a disposable wet mopping pad. Those attachment structures are more fully described in copending U.S. application Ser. No. 09/364,714, filed Aug. 13, 1999, to Kingry, et al., now U.S. Pat. No. 6,305,046 issued Oct. 23, 2001, the substance of which is hereby fully incorporated herein by reference. However, while this solution seems to be a better solution than having two separate implements, it is still not ideal. For example, when a dry mop implement is used with a disposable wet mopping pad, the handle's characteristics of the mop may not be appropriate to endure the stress applied to the handle during wet cleaning due to the handle limited strength and pole length. In addition, this solution may render the two step cleaning unpractical. All the accessories needed to perform this two step cleaning, i.e., dry followed by wet cleaning, would become somehow too cumbersome since the user would need to dispense liquid by using a hand held sprayer or a squirt bottle. While a wet cleaning implement may not have any of the handle strength or length issues and while it is more practical to use since the liquid is directly carried and dispensed from the mop, simply adding attachment structures to the mop head in order to allow it to be used with the cleaning sheets can also lead to problems. Specifically, the consumer would have to be cautious and avoid having the dry dusting sheet come into direct contact with the Velcro® hooks, which are typically used at the bottom of the wet cleaning implement to attach an absorbent pad, or the hooks may become contaminated with fibers from the cleaning sheet and potentially render the wet mop inoperable. In order to prevent contamination of the hooks, each time a consumer wants to perform dry cleaning with a wet mop, the user will have to first attach a disposable wet mopping pad which will act as a barrier between the dry dusting sheet and the hooks. The dry dusting sheet is then wrapped around the pad and tucked into the attachment structures that have been built into the top of the mop head. This solution is quite inconvenient for the user. In order to avoid this problem, an adapter plate in the form of a dry dusting plate which gives to the consumer the convenience and flexibility to easily switch from dry dusting to wet mopping with the same implement has been invented.

Figure 4:
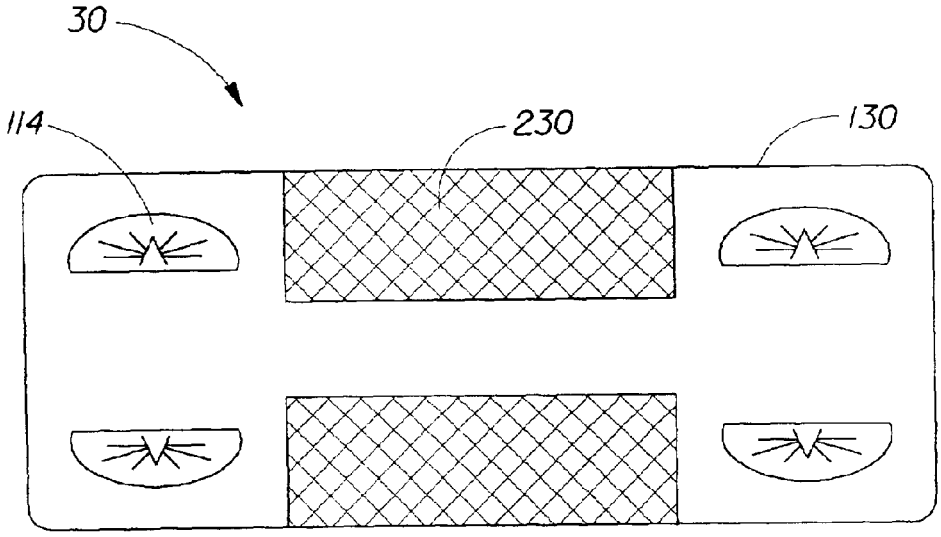
FIG. 4 is top view of a dry dusting adapter plate made in accordance with the present invention.

Referring to FIG. 4, an adapter plate 30 allowing a wet mop to be used for dry cleaning is illustrated. An adapter plate 30 comprises a substantially rectangular plate 130 comprising at least one attachment structure 114 capable of retaining a sheet (not shown for clarity). One skilled in the art will understand that the adapter plate 30 can have many other shapes and still provide the same benefits. In the illustrated embodiment, the plate 130 comprises four attachment structures 114 located on the top of the plate at about the four corners of the plate. Those attachment structures may be located on the top or on the bottom surface of the adapter plate. The plate 130 also comprises Velcro® loops 230 attached to the top surface of the plate 130 and capable of removably securing the adapter plate 30 to the bottom of the mop head 320 of a wet mop 20, shown in FIG. 3, by engaging Velcro® hooks 322 already built into the bottom of the mop head. While the adapter plate of this embodiment uses Velcro® loops to attach directly to Velcro® hooks located at the bottom of the mop head, in the event the mop head does not include Velcro® hooks or loops, other kinds of securing means may be used and provide the same benefits. Such securing means may be, for example, grippers 114 located at top of mop head. The cleaning sheet is then wrapped around the dry dusting adapter plate 30 and tucked into place in the attachment structures 114 of the mop head. In the event the mop head does not already include built in Velcro® hooks or loops, Velcro® hooks and loops can also be sold as part of an adapter plate kit such that these can be removably attached to bottom of a mop head by the consumer. Alternatively, the adapter plate 30 can also include other securing means such as straps or belts which would be wrapped around the mop head and the adapter plate 30 to secure the plate in place. These straps can comprise, for example, Velcro® loops on one strap and Velcro® hooks on the opposite strap such that they can allow the dry dusting plate to be quickly attached and removed from mop head.

Figure 5:
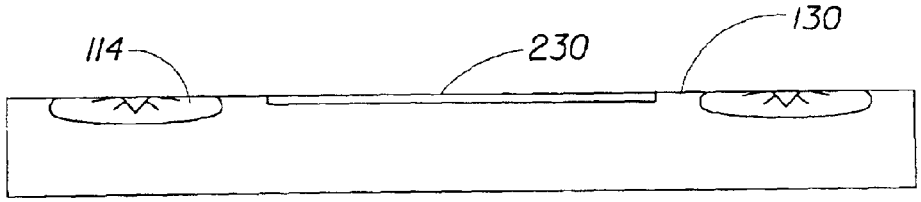
FIG. 5 is a front view of the dry dusting adapter plate of FIG. 4.
Figure 6:
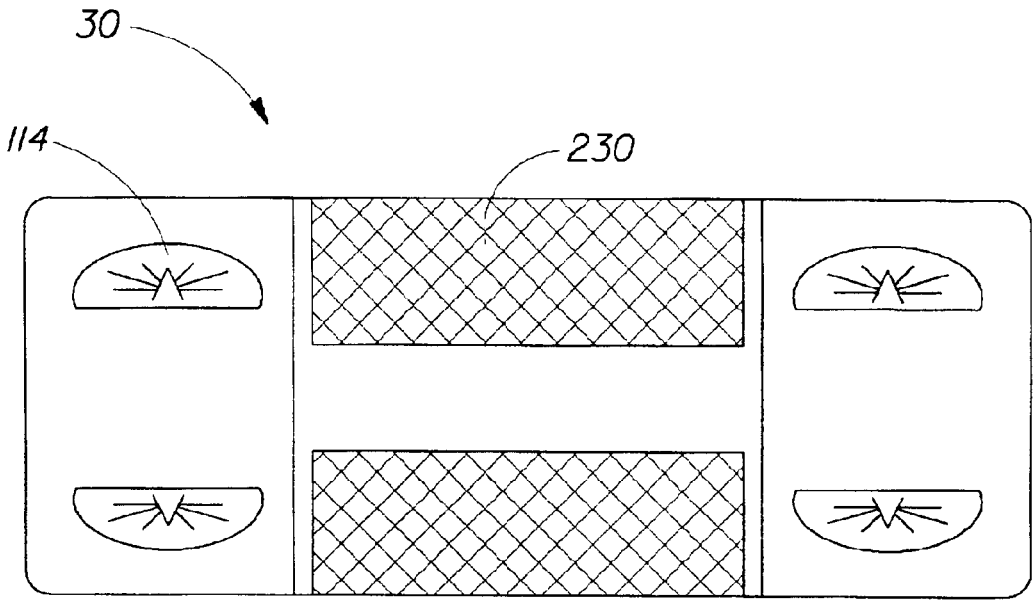
FIG. 6 is a top view of another preferred adapter plate made in accordance with the present invention.
Figure 7:
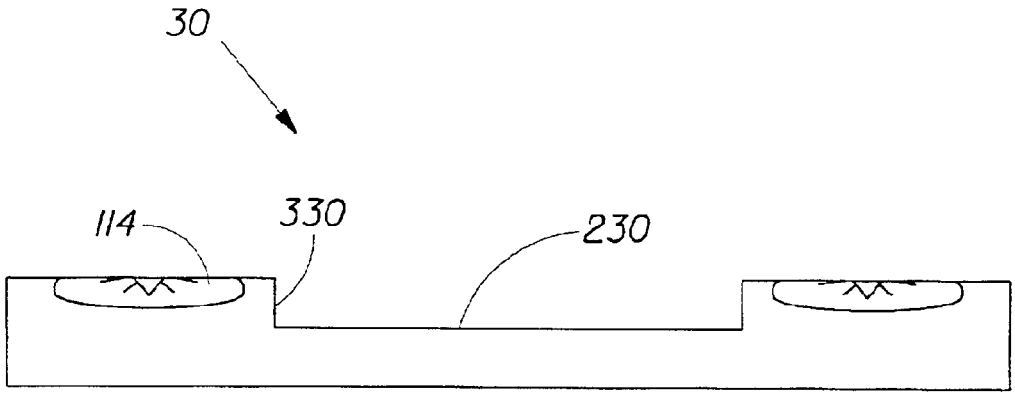
FIG. 7 is a front view of the adapter plate of FIG. 6.
Figure 8:
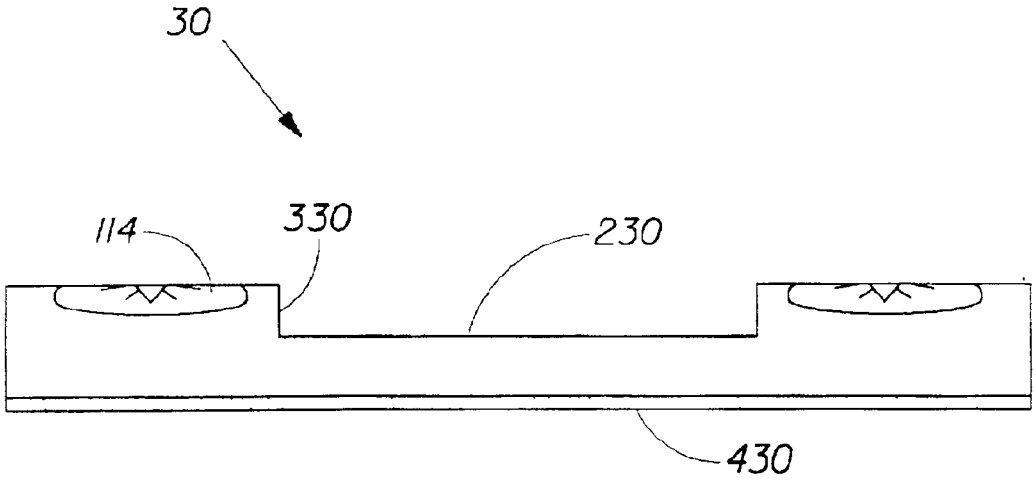
FIG. 8 is a top view of another preferred adapter plate made in accordance with the present invention.
Figure 9:
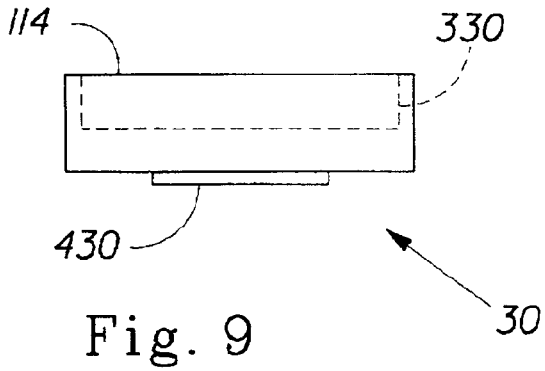
FIG. 9 is a front view of the adapter plate of FIG. 8.
Figure 10:
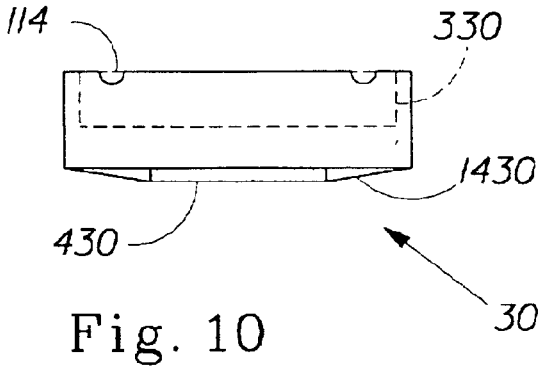
FIG. 10 is a side view of another preferred adapter plate made in accordance with the present invention.

A dry dusting adapter plate 30 represented in FIG. 4 and 5 is sized such that it is longer (relative the x dimension) than the mop head of a wet cleaning implement 20 and has substantially the same width (relative the y dimension). An adapter plate 30 which is longer than the mop head 320 of an implement gives the ability to use the cleaning implement with longer dry dusting sheets so that a greater surface area can be covered with a fewer number of wiping strokes. In another embodiment of the invention, the adapter plate 30 is wider than the mop head and has a length which is not greater than the mop head's length. In yet another embodiment of the invention, the adapter plate is both wider and longer than the mop head of the cleaning implement. It has been found that for securing purposes it is beneficial to have a notch 330 cut out in the plate as represented in FIGS. 6 and 7. Additionally, it has been found that adding a specific geometric shape to the bottom of the adapter plate 30 or having a textured surface at the bottom of the plate can make the plate even more beneficial for effective collection of dry particulate. For example, a crown design or a step design may be incorporated as described in Provisional U.S. application serial No. 60/184,780 to Willman, et al., and U.S. application Ser. No. 09/723,026 to Policicchio incorporated herein by reference. An adapter plate with a step design comprises an elevational element 430. This embodiment is schematically represented in FIGS. 8 and 9. In yet another embodiment of the invention schematically represented in FIG. 10, the bottom of the plate is beveled and comprises a substantially flat centered elevational element 430 and angled sides 1430. The material used for the bottom of the adapter plate may be either substantially rigid or flexible.

Figure 11:
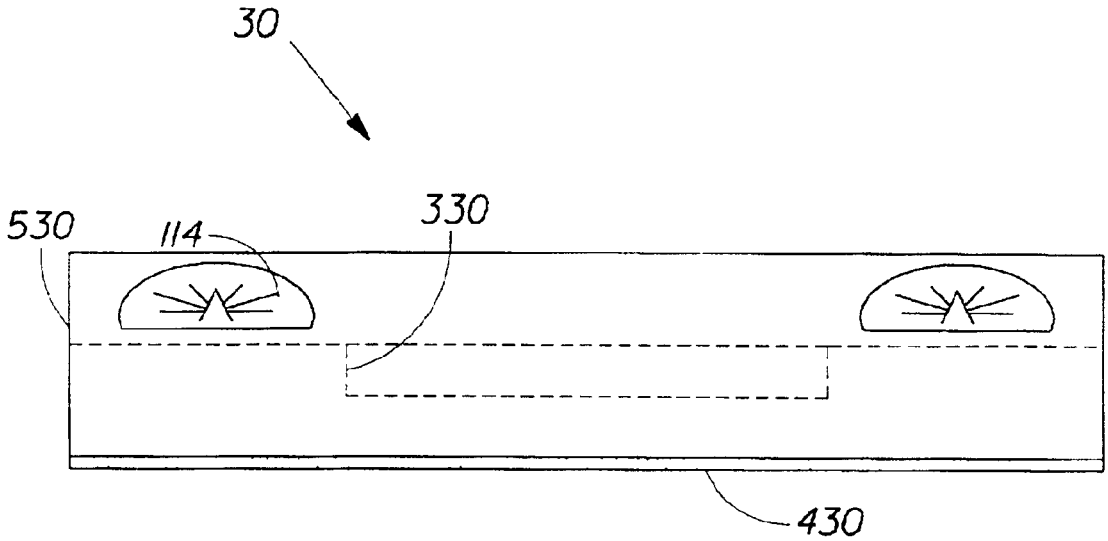
FIG. 11 is a top view of another preferred adapter plate made in accordance with the present invention.
Figure 12:
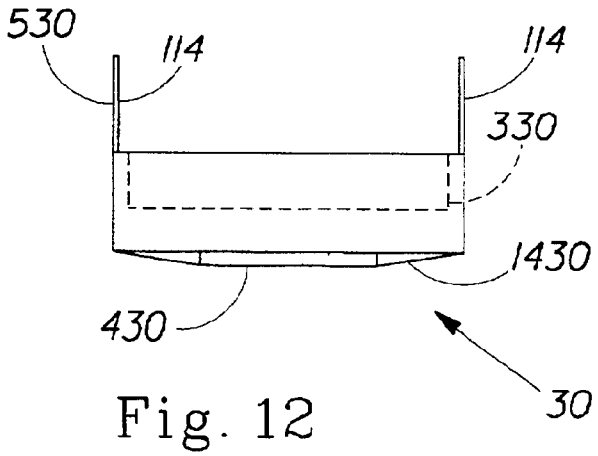
FIG. 12 is a side view of the adapter plate of FIG. 11.
Figure 13:
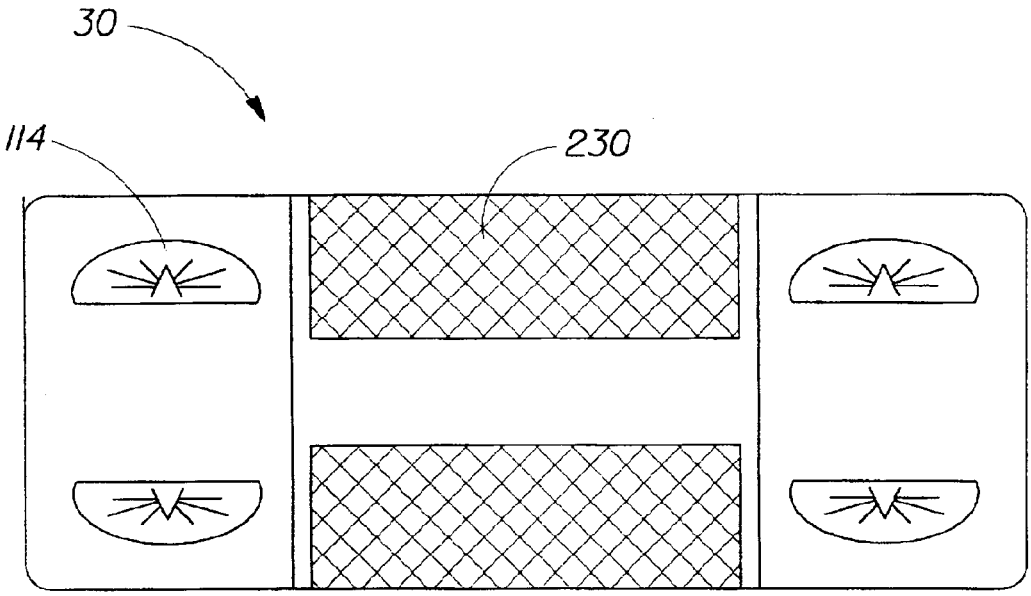
FIG. 13 is top view of an expansion adapter plate made in accordance with the present invention.
Figure 14:
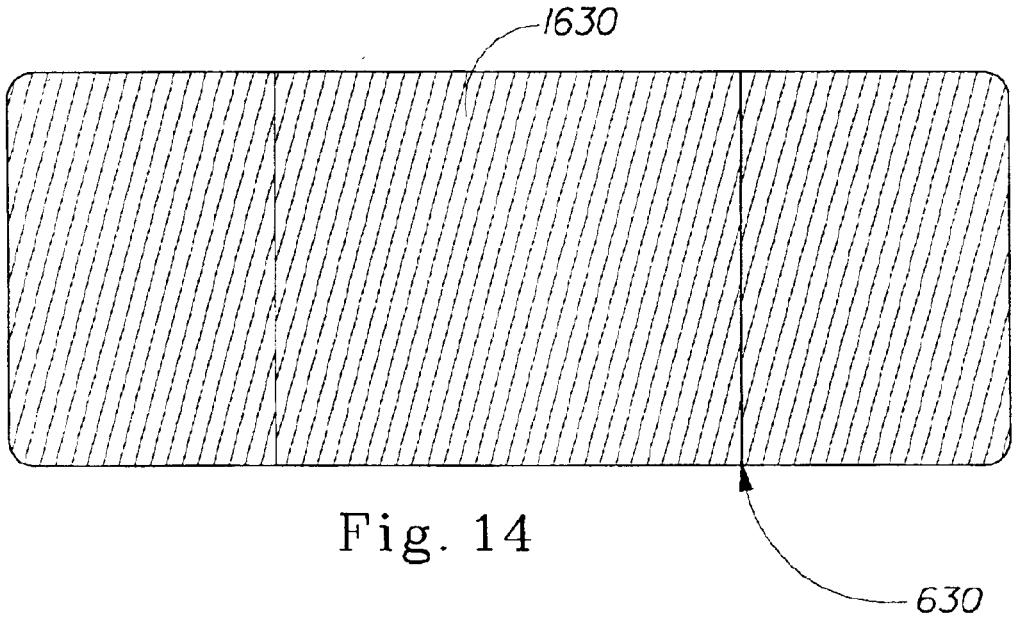
FIG. 14 is a bottom view of the adapter plate of FIG. 13.
Figure 15:
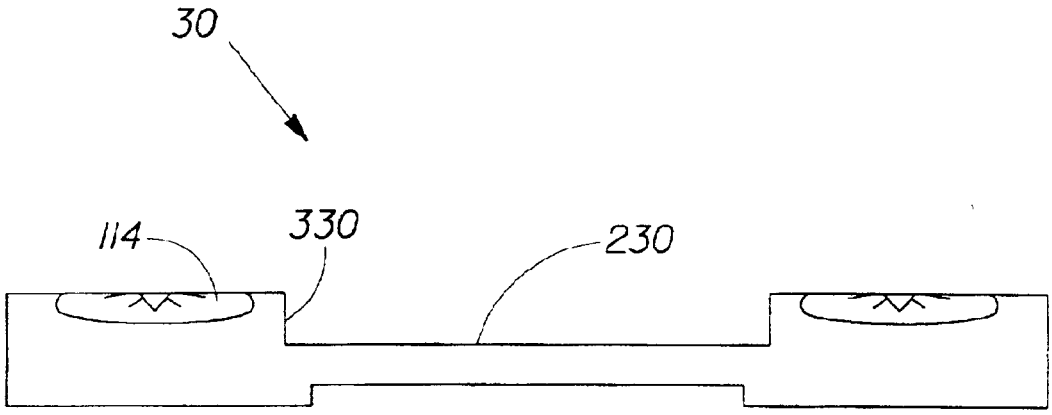
FIG. 15 is a front of the adapter plate of FIG. 13.
Figure 16:
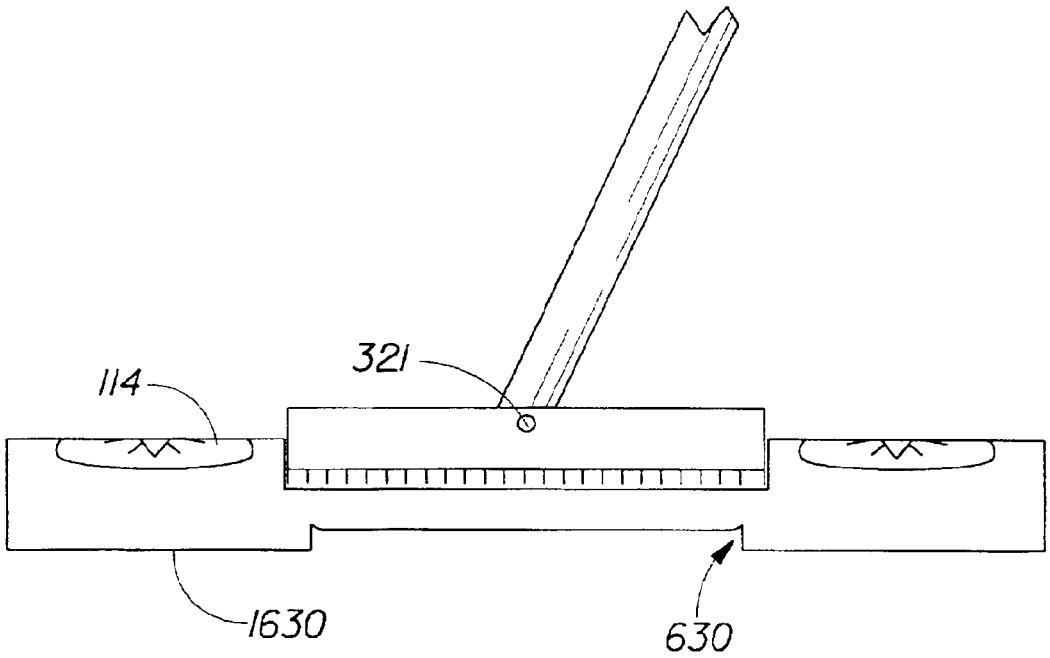
FIG. 16 is a front view of the adapter plate of FIG. 13 shown attached to a wet cleaning during use.

In another embodiment of the invention schematically represented in FIGS. 11 and 12, the "dry dusting" adapter plate 30 comprises a lower portion 430 which is facing the surface to be cleaned (i.e. x-y dimension) and at least one side panel 530 which extends from one edge of the plate 130 and away from the surface to be cleaned (i.e. in the z dimension). The side panel is angled relative the lower portion of the plate. In this embodiment, the attachment structures are located on the side panel 530 of the plate. In a preferred embodiment, the "dry dusting" adapter plate comprises two side panels 530 substantially perpendicular to the plate 130 and facing each other with two attachment structures 114 on each side panel. The dry dusting sheet is attached by wrapping it around the adapter plate and then securing it to the plate 30 with the attachment structures 114. This embodiment with side panels 530 is particularly useful since it allows for a better coverage and use of a dry dusting sheet, and it allows baseboards to be dusted at the same time the floor is dusted. This embodiment also allows current regular size dusting sheets, which are already on the market, to fit easily onto a plate which has a coverage surface substantially similar to the coverage surface of an existing dry dusting mop head. As a result, there is no need in this case to redesign and manufacture new dry dusting sheets.

The present invention further encompasses articles of manufacture comprising the above-described dry dusting adapter in association with a set of instructions, which can be combined with a package, carton, or other container. As used herein, the phrase "in association with" means the set of instructions are either directly printed on the adapter plate itself or presented in a separate manner including, but not limited to, a brochure, print advertisement, electronic advertisement, and/or verbal communication, so as to communicate the set of instructions to a consumer of the article of manufacture. The set of instructions preferably comprise the instruction to use the dry dusting adapter plate for hard surface cleaning with a wet cleaning implement, such as a floor mop, having a handle and a mop head. For example, the instruction might instruct using the cleaning sheet with a wet cleaning implement having Velcro® hooks at the bottom. Other instructions might instruct a user to keep a dry dust sheet always attached to the adapter plate to facilitate switching from dry to wet cleaning. Other instructions might instruct a user to first perform the dry cleaning operation with the adapter plate and a dry dusting sheet and then, after having removed the adapter plate, to perform a wet cleaning operation with a wet cleaning implement with an absorbent pad.

As discussed more fully hereafter, another aspect of the present invention is directed to adapter plates (which in one of the embodiments can be considered to be a "expansion plate"), which allow a wet cleaning mop to be used with wider or longer mopping pads and a dry cleaning mop to be used with wider or longer dry dusting sheets.

As discussed previously, one of the benefits associated with performing the mopping operation with a wider/longer pad or sheet is that it makes cleaning of a surface faster and easier since more area can be covered with fewer wiping strokes. In addition, during the course of wet mopping, a liquid solution is typically sprayed on the surface to be cleaned. As a result, it becomes important that the consumer overlap the wiping strokes in order to get even coverage during the forward and backward wiping motion. Since the liquid solution can be difficult to see on the surface to be cleaned, the user will often notice puddles of liquid where she missed wiping. This is particularly inconvenient since the user will need to try to avoid stepping in the wet spots left after wiping, and can also lead to poor quality end results caused by the residue left by the liquid and unremoved dirt which dries on the floor. Applicants have discovered that those problems can be solved by using a wider/longer pad. The amount of puddles on the surface decreases when a wider or longer pad is used since fewer overlapping of wiping strokes is required to clean the same area. In fact if the pad is made long enough, it becomes almost impossible for the consumer not to overlap wiping strokes. With a long enough pad the consumer would need to mop at such an extreme angle to miss over-lapping that it would be too uncomfortable to mop.

The dimensions of a standard size wet mopping pad is typically about 150 mm wide by about 300 mm long. In one embodiment of the invention, the length of a wider/longer pad is increased by at least about 50% of the standard size wet mopping pad to be beneficial but this increase should preferably not exceed about 150% of the length of the standard size wet mopping pad or it may become too cumbersome to push across the floor. The width of the wider/longer pad may either stay the same as the width of the standard pad or may be increased up to about 50% of the width of a standard pad. One skilled in the art will understand that the dimensions of the adapter plate will be such that the plate will allow the user to secure a cleaning pad to the adapter plate 30 and will also allow the cleaning pad to stay substantially in contact with the surface to be cleaned. Applicants have also found that when a wider/longer pad is used, the friction between the surface to be cleaned and the pad are increased, and as a result, the stress applied by the pad on the attachment structure is also increased. In order to better secure the cleaning pad on the mop head, the mop head of the cleaning implement may require an improved attachment mechanism capable of retaining a wider/longer pad while the cleaning is done. In the case of a typical wet cleaning implement where the securing means used to secure a pad to the mop head is usually in the form of Velcro® hooks and loops, one solution is to increase the surface covered by Velcro® material. In another embodiment where the securing means is in the form of attachment structures 114 such as grippers located on top of the mop head or on top of the expansion plate and where attachment wings of the pad or sheet are inserted in those attachment structures, the number or size of these grippers can be increased. In another embodiment, the top of the mop head or expansion plate comprises a set of hinged plates which can be lifted up to provide channels to tuck the attachment wings and then are snapped down to hold those wings in position. In yet another embodiment, an adhesive layer can be added to the top surface of a cleaning pad. The top surface of the cleaning pad is then pressed against the bottom surface of the mop head or expansion plate. One skilled in the art will understand that the amount of adhesive on the cleaning pad and the adhesive strength are such that a cleaning pad will be secured during the cleaning operation, but should still allow a user to remove the pad after use. In order to prevent the adhesive layer to dry out, and in order to prevent the cleaning pads to stick to each other, a protective release paper can be applied on the top of the adhesive layer In one embodiment of the invention, the mop head 320 of a wet mopping cleaning implement 20 comprises Velcro® hooks 322 on its bottom surface which are capable of engaging and therefore retaining Velcro® loops 230 located on the top surface of an expansion adapter plate. As described previously, a notch 330 can be cut out of the top part of the expansion adapter plate as described FIGS. 11 and 12. This notch is slightly wider than the mop head onto which the expansion plate is attached. One of the benefits of having a notch 330 in the expansion plate is that it keeps the mop head 320 more secure within the expansion plate 30 and allows the mop head to be at a lower position. It has been found that the mop is actually easier to push on the surface to be cleaned when the mop head is lowered. It has also been found that the spray pattern of a cleaning implement comprising a spraying mechanism with a nozzle 321 located on the mop head 320, is optimized when a notch 330 is made on the expansion plate 30 and helps to prevent the formation of puddles of liquid on the surface. It has been discovered that having a specific topographical design at the bottom of an expansion adapter plate 30 results in a better pad utilization and is therefore beneficial to improve cleaning efficiency and performance. An example of an adapter plate 30 with a specific topographical design at the bottom is schematically represented FIG. 13 through FIG. 16. It has been discovered that creating pressure zones on a cleaning pad by ways of discontinuities 630 in specific locations of the bottom surface of the mop head and/or the expansion plate helps to improve solution absorbency. In the case of the large pad expansion plate, not only is there a need to cause absorption of the liquid through the center of the pad, but there is also a need to cause absorption of liquid at the outer extremities of the pad (relative the x-y dimension). Applicants have found that if the bottom surface of the expansion plate 30 is flat, the addition of a full length elevational element in the center of the expansion plate, as described in U.S. application Ser. No. 09/723,026 incorporated herein by reference, is insufficient to cause a liquid solution to be absorbed at the outer extremities of the pad. However, when a notch is also cut out of the bottom surface of the expansion plate such that the notch length is slightly shorter than the length of the mop head attached to the expansion plate, the solution absorbency in the outer extremities of the pad is improved. With such a notch, pressure zones are created across the width of the outer extremities of the pad rather than across the length of a pad, as it is the case with the centered step design extending along the entire length of the mop head. This notch can be formed either during the molding operation of the expansion plate or by securing at least one elevational element 1630 at each extremity of the bottom surface of the expansion plate 30.

Figure 17:
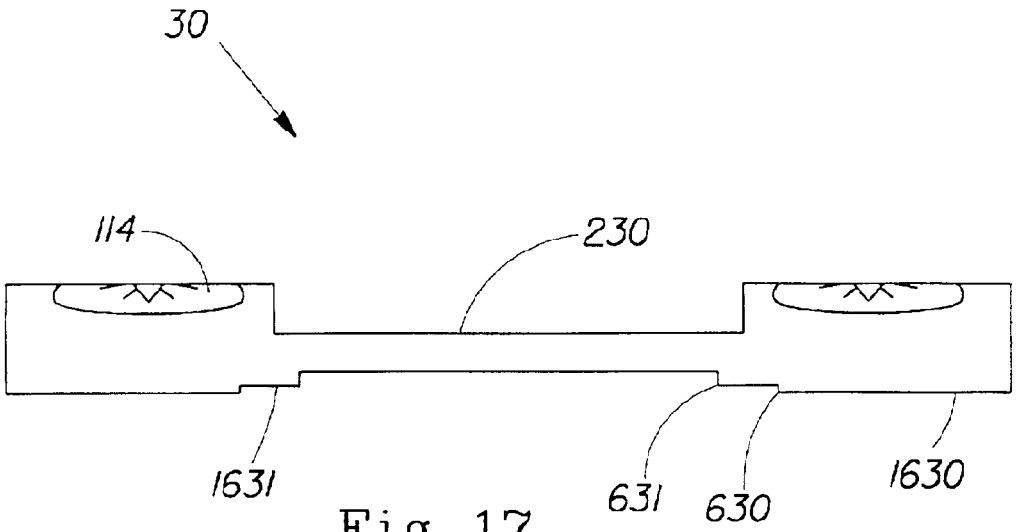
FIG. 17 is a front view of another preferred expansion adapter plate made in accordance with the present invention.
Figure 18:
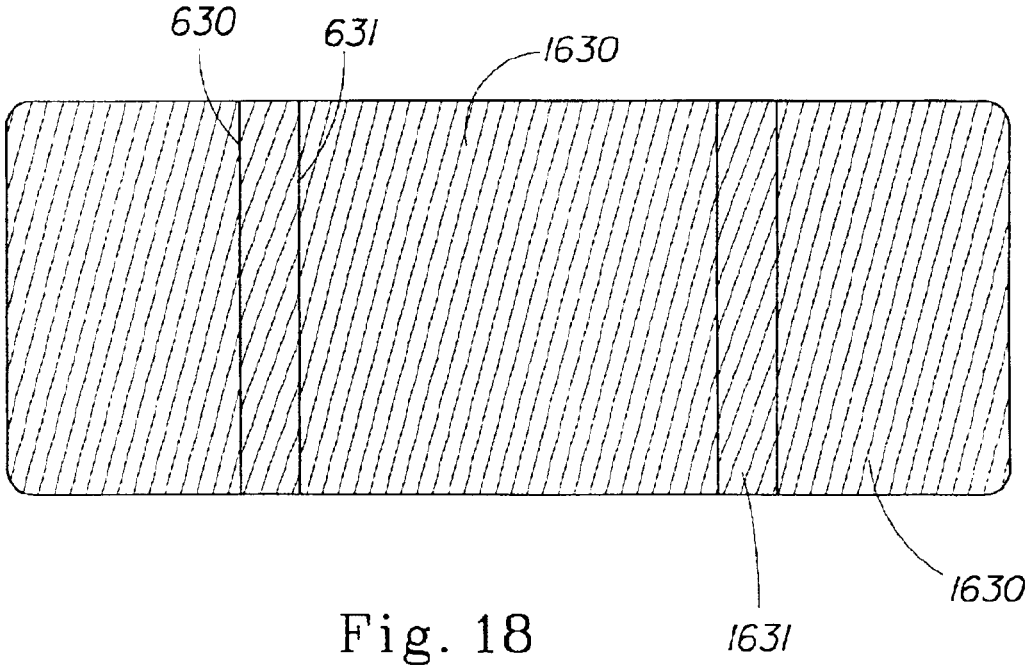
FIG. 18 is a bottom view of the adapter plate of FIG. 17.

In another embodiment of the invention, a succession of notches is cut out of the bottom surface of the expansion plate or a succession of elevational elements 1630 are secured at each extremity of the plate 130. An example of this embodiment is schematically represented FIGS. 17 and 18. In this embodiment, the plate 30 is optimized to minimize weight while creating several pressure zones in the pad. The surface discontinuities 630 and 631 on the bottom of the expansion plate 30 create "pressure barriers" in the pad which in turn help the longitudinal transfer of the liquid towards the extremities of the pad. Without intending to be bound by any theory, it is believed that during the forward and backward mopping motion, pressure is alternatively being applied and released on the expansion plate 30 and the pad via the handle. As a result, the pressure zones are successively generating pressure gradients in the pad which alternatively appear and disappear. This alternation acts as a pump in the pad resulting in a more uniform distribution of the liquid along the pad.

In yet another embodiment of the invention, at least two elevational elements 1630 and 1631 having different length and/or width are secured at each extremity of the expansion plate 30. In another embodiment of the invention, the bottom surface of the expansion plate is continuous and is at least partially curved towards the top surface of the expansion plate.

Figure 19:
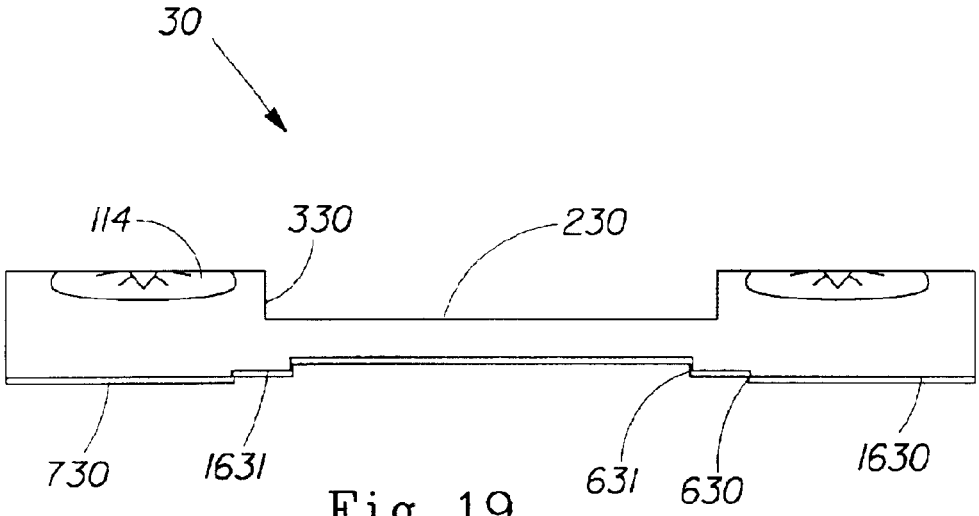
FIG. 19 is a front view of another preferred expansion adapter plate made in accordance with the present invention.
Figure 20:
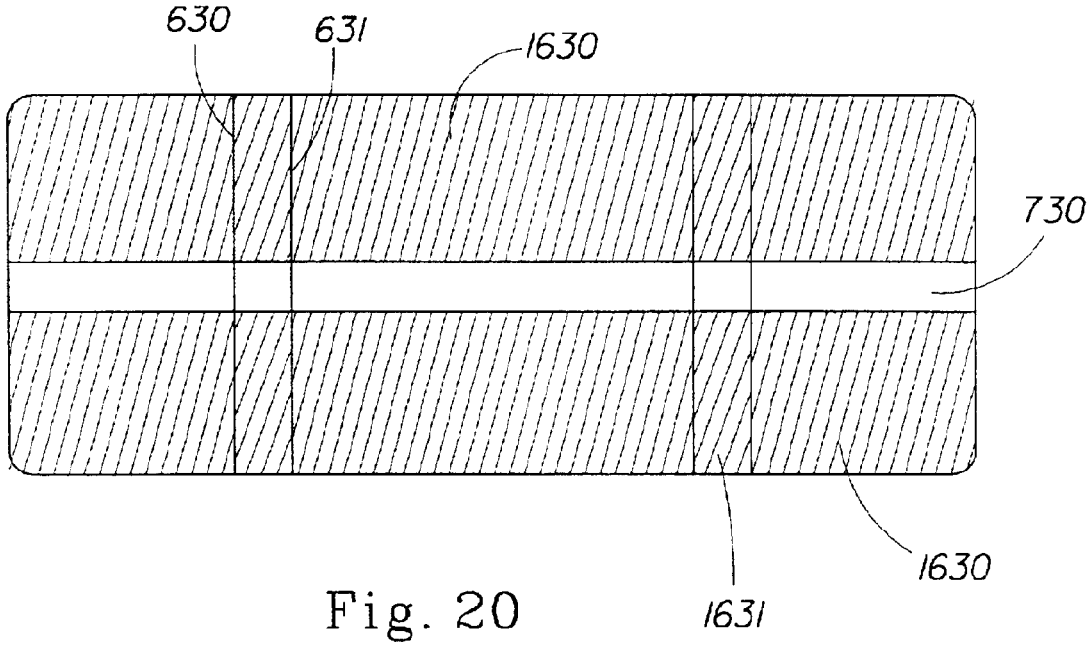
FIG. 20 is a bottom view of the adapter plate of FIG. 19.
Figure 21:
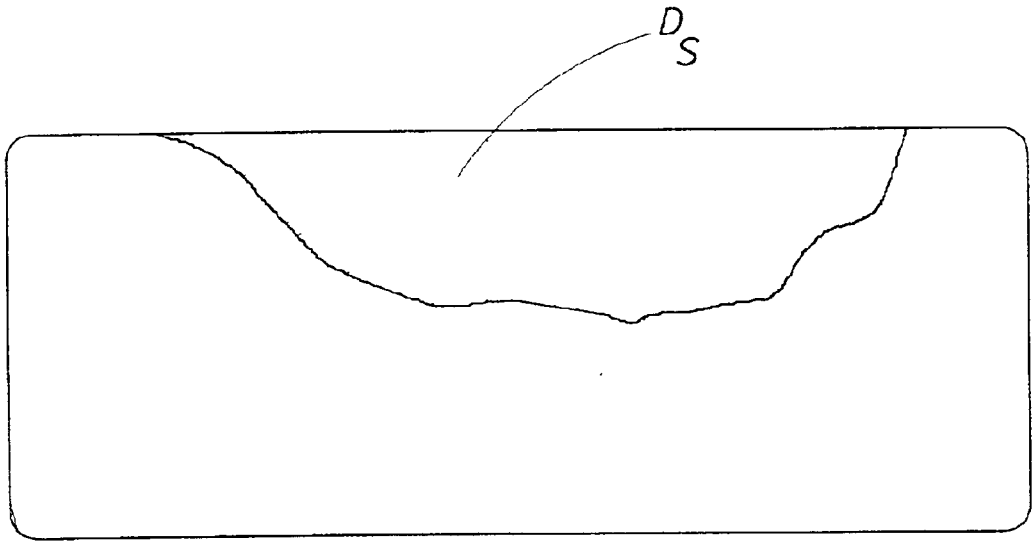
FIG. 21 is a schematic representation of the bottom of a cleaning pad having been used with a flat adapter plate.
Figure 22:
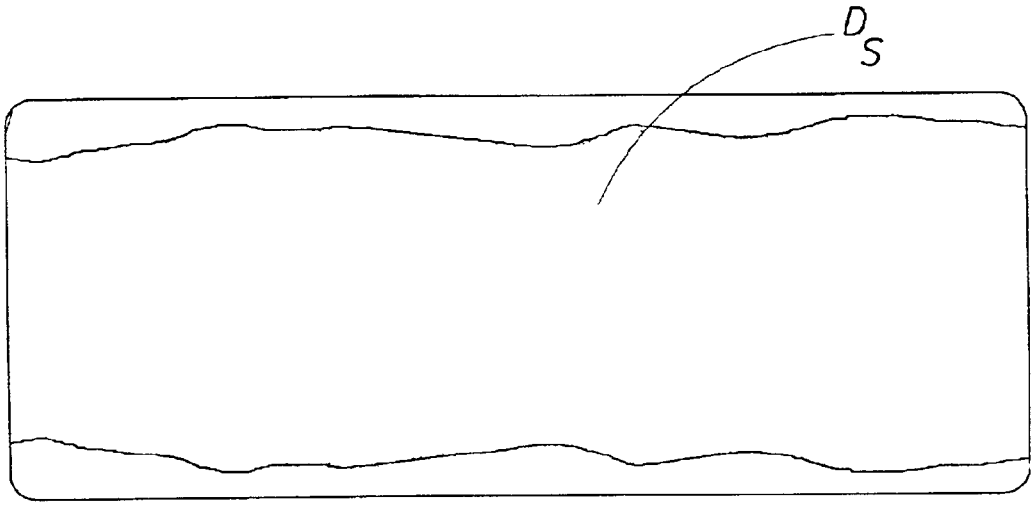
FIG. 22 is a schematic representation of the bottom of a cleaning pad having been used with one embodiment of the present invention.
Figure 23:
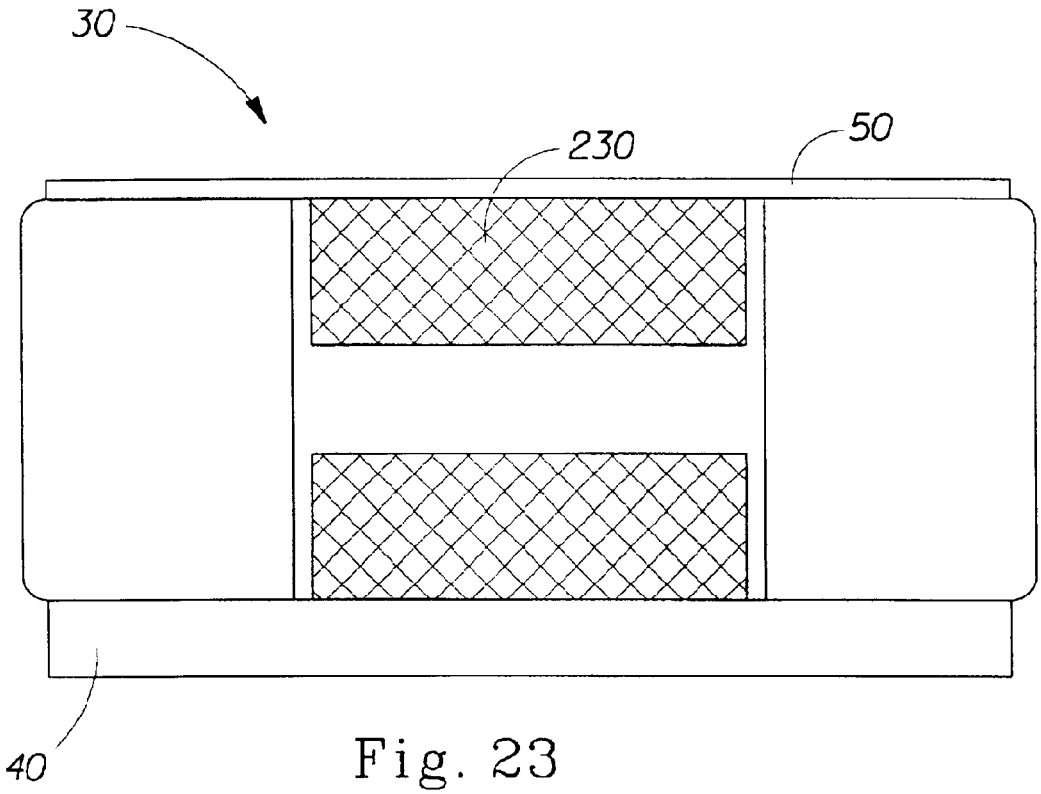
FIG. 23 is top view of a scrubbing adapter plate made in accordance with the present invention.
Figure 24:
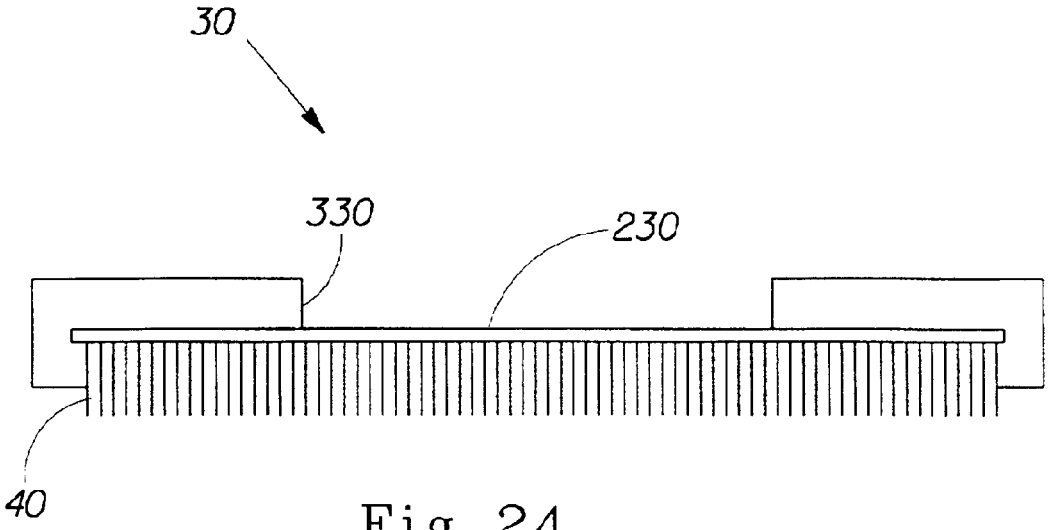
FIG. 24 is a side view of the adapter plate of FIG. 23.
Figure 25:
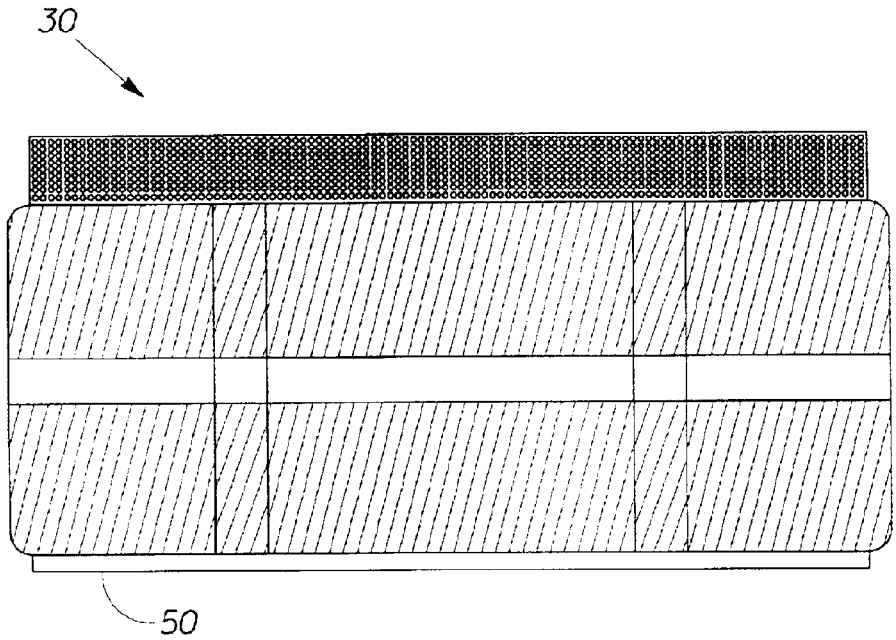
FIG. 25 is a bottom view of the adapter plate of FIG. 23.

In yet another embodiment of the invention, the bottom surface of the expansion plate 30 also comprises at least one longitudinal elevational element 730 located in the center of the bottom surface and extending along the length of the bottom surface. This embodiment is schematically represented FIGS. 19 and 20. This longitudinal elevational element creates a pressure zone in the center portion of the pad relative to its width. When downward pressure is applied to the implement the multiple pressure points created by the multiple elevational elements on the extremities of the plate and full length centered elevational element allow liquid to be uniformly absorbed and distributed in the pad. It has been found that the absorptive efficiency for both longer "standard" cleaning pads and longer "Light duty" cleaning pads is improved when wiping is done with an expansion plate having discontinuities generating pressure zones on the pad as compared with an expansion plate with a flat bottom. By observing the used pads which were tested with each plate, it is apparent that having an expansion plate having discontinuities on its bottom causes the cleaning solution to be absorbed through the longitudinal extremities of the pad and center of the pad rather than at the leading edge and middle portion of the pad. As a result, each cleaning pad tested is capable of absorbing a greater quantity of liquid and thus the cleaning efficiency of the cleaning pad is improved. This observation is schematically illustrated by FIG. 21 which shows where the dirty solution Ds is absorbed on a cleaning pad tested with a flat expansion plate and FIG. 22 which shows where the dirty solution Ds is absorbed on a cleaning pad tested with an expansion plate having discontinuities. In embodiments of the invention comprising a notch 1630 at the bottom of the expansion adapter plate 30, the portion of the plate which is the thinnest is flexible such that when the plate is used with the implement, enough pressure is applied during the forward and backward mopping motion to make this portion of the plate at least partially collapse and fill in a hollow area (schematically represented in FIG. 16). As a result, the extremities of the pad are subject to more pressure which, in turn, allows the liquid solution to be better absorbed by the pad.

One skilled in the art will understand that those substantially flat elevational elements (relative the x-y plan) used to create pressure zones in the pad can have other geometries or designs and still offer the same benefits. For example, the elevational elements can have rounded sides, angled sides and/or be textured. In addition, the bottom of the expansion plate can have a crowned design as previously described. It can also have a crowned design combined with at least one elevational element.

In each embodiment of the invention, the bottom portion of the expansion plate and its topography can be made of either stiff non-pliable materials such as high density polyethylene and/or more pliable materials, or materials with lower durometry such as foams, sponges, polyester wadding, encased gels or liquids and the like. In one embodiment, the elevational element which is furthest away from the center of the expansion plate which is the most pronounced and is the closest to the floor, can be made of pliable material, while the other elevational element can be made of a more rigid material. In one embodiment of the invention, the elevational elements of the expansion plate are all made of a rigid material. In this case, the expansion plate may also include a pliable bumper guard located around the circumference of the plate to provide protection when the user is mopping a surface.

In yet another embodiment of the invention, an expansion adapter plate is provided which allows longer and/or wider cleaning sheets to be used with an existing dry cleaning implement. In this embodiment, the adapter plate comprises at least one, but preferably four attachment structures 114, located on the top surface of the adapter plate, preferably at each corners of the top surface. One skilled in the art will understand that there are several ways to removably attach the expansion adapter plate to the mop head of a dry cleaning implement. For example, Velcro® straps attached to the adapter plate, rubber bands or any equivalent can be used. In one embodiment of the invention, the top surface of the expansion adapter plate comprises a notch forming a hollow space and having a width and length such that the mop head of a dry cleaning implement can be forceably lodged in this hollow space and forceably removed from this hollow space.

Providing specific instructions for use with the larger head expansion plates can be beneficial. For example it has been found that when using the larger head expansion plate with a disposable absorbent mopping pad, the increased size of the mop head makes it difficult to clean in smaller rooms or in tighter spaces. As a result, in order to provide a better cleaning experience, consumers will be instructed to first clean with a regular size pad on a current mop in all the small rooms and tight spaces such as under furniture etc. Consumers will be then instructed to remove the regular size pad, attach the larger head expansion plate to the implement with a larger pad and then finish cleaning in the wider open areas. In fact, this flexibility of being able to quickly convert the implement from a regular size to a large size, and vice-versa, adds to the convenience. In order to provide a better value and better hygiene to the consumers, one option is to sell the larger head expansion plate as part of a kit which can include larger size pads and light duty standard size pads for use in smaller areas. Additionally, if a large expansion plate is also designed to be used with dry dusting/sweeping sheets, those sheets can also be included as part of the kit with specific instructions for use.

Figure 26:
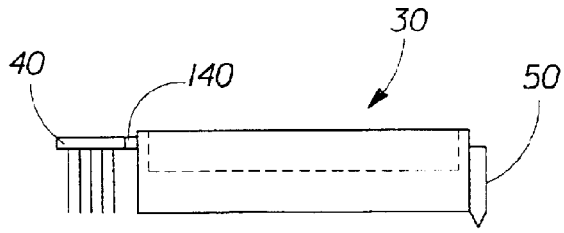
FIG. 26 is a side view of the adapter plate of FIG. 23 showing the scrubbing element in the downward position.

As discussed more fully hereafter, another aspect of the present invention is directed to adapter plates (which in one of the embodiments can be considered to be a "scrubbing plate") which allow a dry or wet cleaning mop to be used for tough stain removal or scrubbing. While a scrubbing element can be incorporated into a pad or can be added to the mop as a scrubbing strap, those may not be sufficient to remove tough stains or stains which are hard to reach, such as for example in grout lines between ceramic tiles. In order to perform this kind of "heavy cleaning", any of the previously disclosed adapter plates 30 can further include a durable brush 40 or scrubby which is added to one or more of the edges of the adapter plate 30. Preferably, at least one brush 40 is located on one of the longitudinal edges of the scrubbing plate 30, most preferably on the leading edge of the scrubbing plate relative the forward motion of the mop during cleaning. This embodiment is schematically represented FIG. 23 through FIG. 27. In one embodiment, a scrubbing brush is attached to a hinge 140. This hinge 140 allows the scrub brush to be engaged when needed by flipping it downward as schematically represented in FIG. 26. When the brush is not needed, it can simply be disengaged by flipping it upward and resting on the top of the adapter plate, as schematically represented in FIG. 27.

Figure 27:
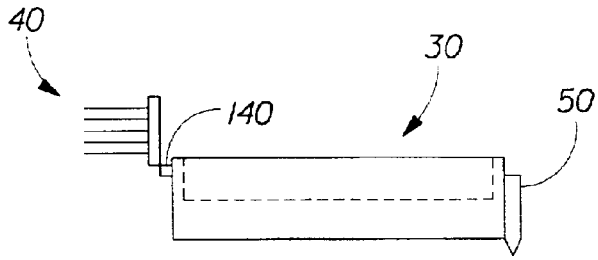
FIG. 27 is a side view of the adapter plate of FIG. 23 showing the scrubbing element in the upward position.

In another embodiment of the invention represented FIGS. 26 and 27, the scrubbing plate comprises at least one squeegee 50 located on one edge of the scrubbing plate 30. Preferably, the squeegee is located on a longitudinal edge of the scrubbing plate. In one embodiment, the squeegee 50 is located on the leading edge of the scrubbing plate between the scrubbing brush and the longitudinal edge of the plate. In another embodiment, the squeegee is located on the trailing edge of the scrubbing plate. The squeegee is beneficial by helping to concentrate dirty liquid that is spread out into puddles which are easier for a pad to absorb. In fact, a scrubbing plate with a scrubbing brush 40 and a squeegee 50 has been shown to be beneficial as part of a floor restoration device when floors have a significant level of embedded and built-up dirt caused by aging and inadequate cleaning. With a floor restoration device, a heavy-duty liquid cleaner that penetrates deep into surfaces is applied to the floor which is then scrubbed thoroughly for several minutes. The excess liquid and loosened dirt is then collected with a squeegee 50 into a small puddle. The implement with the scrubbing plate 30 can then be used to attach an absorbent pad, and the pad pushed over the puddle to absorb the dirt solution. The floor restoration tool comprises an adapter plate 30 with a scrubbing element or brush 40 and a squeegee 50 combined all into one, such that the scrubbing plate can be removably secured with for example Velcro® hooks and loops to an implement which also has Velcro® hooks or loops on the bottom. Alternatively, the scrubbing plate can be secured with straps, belts, snaps and the like to implements which do not have Velcro®. Another solution is to provide Velcro® straps with the scrubbing plate system such that the consumer can attach those Velcro® strips to the bottom of their existing implement. The brush or scrubbing surface 40 at the bottom of the scrubbing plate 30 can be designed such that a pad can be attached and removed easily even when it gets wet during scrubbing.

As discussed more fully hereafter, another aspect of the present invention is directed to adapter plates (which in one of the embodiments can be considered to be a "wet cleaning plate"), which allow a dry cleaning mop to be used with standard mopping pads and a dry cleaning mop to be used with wider or longer dry dusting sheets.

As discussed previously, the cleaning efficiency is increased if dry cleaning of a surface is performed prior to the wet cleaning of this surface. There are several ways for a consumer to perform wet cleaning of a surface. One of them is to use a wet cleaning implement comprising a container in fluid communication with a fluid delivery mechanism and an absorbent pad attached to the mop head of the wet cleaning implement with Velcro® hooks and loops. These wet cleaning implements are generally more expensive than existing dry cleaning implements and, as a result, a consumer who already owns a dry cleaning implement may be reluctant to invest in a second implement for wet cleaning. The wet cleaning adapter plate allows a consumer to use her dry cleaning mop with absorbent pads designed for wet cleaning implements. In this embodiment, a substantially rectangular adapter plate comprises Velcro® loops or hooks at its bottom surface and securing elements for removably securing the adapter plate to the mop head of a dry cleaning implement such as for example Velcro® straps or rubber bands attached to the adapter plate or such as a notch on the top surface of the adapter plate forming a hollow space and having a length and a width such that a mop head can be removably forced fit in the hollow space of the adapter plate. In this embodiment, a consumer can simply attach the adapter plate to her dry cleaning implement and then attach an absorbent pad having Velcro® hooks or loops to the bottom surface of the adapter plate and having corresponding Velcro® loops or hooks. In order to increase the cleaning efficiency, the bottom surface of the adapter plate may also have a topographical design such as one previously described. Once an absorbent pad is secured to the adapter plate, the consumer can use her dry cleaning mop/wet cleaning adapter plate/absorbent pad assembly for wet cleaning of a surface. This wet cleaning adapter plate can be sold in a wet cleaning kit comprising a wet cleaning adapter plate for a dry cleaning implement, at least one absorbent pad and/or a hand held sprayer for spraying a cleaning solution on a surface.

As discussed more fully hereafter, another aspect of the present invention is directed to adapter plates (which in one of the embodiments can be considered to be a "powered plate") which allows a mop for dry or wet cleaning to be used for enhanced cleaning and/or floor restoration.

In order to facilitate cleaning, a powered plate which can be adapted and attached to existing dry or wet cleaning mops has been invented. In one embodiment of this invention, the powered plate comprises a housing having a top and a bottom surface. The top surface of the housing includes securing members capable of removably attaching the powered plate to the bottom of a mop head of an existing mop. The plate housing includes an electric motor, a voltage source for powering the electric motor, vibrating means coupled to the motor for providing an alternative linear motion to at least one brush, at least one brush located on one edge of the plate housing and coupled to the vibrating means and a switch positioned on the plate housing and having an ON and OFF position for completing an electrical circuit between the motor and the voltage source. In this embodiment of the invention, examples of securing means can be Velcro® hooks and loops, straps, belts, snaps, pressure clips, adhesive tape or any equivalent. In one embodiment, the voltage source is composed of rechargeable batteries connected by electric wires to a printed circuit board comprising a battery charger jack extending through the plate housing. Once the batteries are discharged, the user can connect the charger jack to a charger and thus recharge the batteries. In another embodiment, the voltage source is composed of nonrechargeable batteries such as disposable batteries connected in series. Those disposable batteries can be made accessible by providing a removable cover located, for example, on the top of the plate housing such that the user will have an easy access to the batteries when they need to be replaced. The user can activate the brush very simply by putting the switch in the ON position and use the powered plate to scrub a surface as long as necessary and as long as the batteries can supply enough energy to the electric motor. The powered plate is deactivated by putting the switch in the OFF position. In another embodiment of the invention, the electric motor is coupled to a rotative means for providing a rotating motion to at least one brush. In one embodiment, the rotative brush is positioned in one edge of the powered plate, preferably a longitudinal edge (along the x dimension) of the powered plate. In this embodiment, the rotative brush has substantially a cylindrical shape and its rotational axis is substantially parallel to the x dimension. In yet another embodiment of the invention, the rotative brush is positioned at the bottom surface of the powered plate. In this embodiment, the rotative brush is substantially rounded in shape and its rotational axis is substantially perpendicular to the x-y plan (i.e. perpendicular to the surface to be cleaned). In one embodiment of the invention, the rounded brush is removably attachable to the bottom of a rotative plate coupled to the electric motor. In this embodiment, the rounded brush can be attached to the bottom of the rotative plate by Velcro® hooks or loops. This embodiment is particularly beneficial since it allows different kinds of pads to be attached to the rotative plate. For example, a rounded buffing pad may be attached to the rotative plate to allow polishing of the floor.

As discussed more fully hereafter, another aspect of the present invention is directed to adapter plates (which in one of the embodiments can be considered to be a "carpet plate") which allows a mop for wet cleaning or dry cleaning to be used for carpet cleaning.

Figure 28:
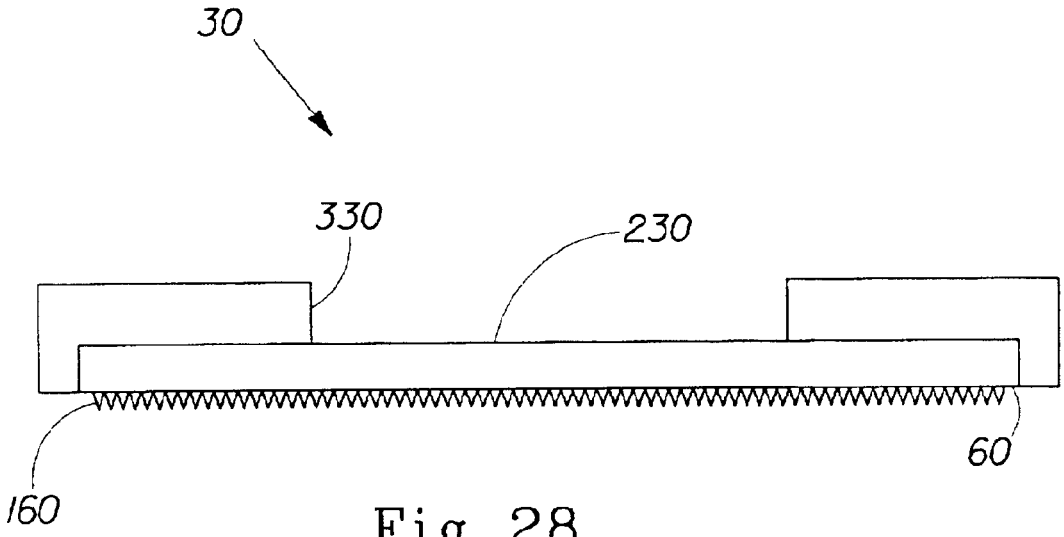
FIG. 28 is a front view of a carpet plate made in accordance with the present invention.

In one embodiment of the invention, a carpet plate having at the bottom surface Velcro® hooks or loops is attached is removably attached to the mop head of a dry cleaning implement and an absorbent pad is removably attached using Velcro® hooks or loops to the bottom of the carpet adapter plate. The Velcro® hooks and loops offer a stronger attachment of the absorbent pad to the adapter plate but one skilled in the art will understand that other attachment structures may be used and offer the same benefits. In this embodiment, a consumer can spray a cleaning solution on the carpet with a liquid delivery system such as a hand held sprayer or an aerosol container and then sweep the implement on the carpet in order to remove and absorb dirt. In another embodiment of the invention, represented in FIG. 28, a scrubbing adapter plate 30 can be used with a dry or wet cleaning implement and with an absorbent pad to remove dirt deeply located in the carpet pile and bring it up to the surface. In order to perform cleaning of a carpet, the user has to saturate the carpet with a cleaning solution and optionally but preferably use the brush on the carpet plate to loosen the dirt in the carpet. The absorbent pad is then wiped across the carpet to absorb the dirty solution. It has been discovered that typical brushes can easily get soiled when used for carpet cleaning and may lose part of its scrubbing ability. In one embodiment of the invention, the brush is replaced by a longitudinal scraping element 60 made of a substantially rigid material capable of penetrating into a carpet without damaging the fibers of the carpet. This embodiment is schematically represented in FIG. 28. In another embodiment, the scraping element comprises teeth 160, resembling a saw blade design, to penetrate further into the carpet. Typically, carpets are very much like a fabric and tend to have a high affinity for holding onto liquids. A longitudinal squeegee 50 can be added to the carpet plate to allow an easier removal of liquid in the carpet. The squeegee helps concentrating the liquid into puddles which are more easily absorbed by the absorbent pad.

In order to improve the liquid absorbing ability of the pad, the consumer can be instructed to press down firmly onto the pad for a few seconds, then release the pressure on the implement and thereafter repeat the operation. This succession of pressure being applied and pressure being released onto the pad creates a pumping action which is beneficial to draw liquid into the absorbent pad. Applicants have discovered that a carpet plate comprising elevational elements as described previously which create pressure zones on the pad, is also beneficial for liquid absorption when used for carpet cleaning.

As is discussed above, to enhance the versatility of a cleaning system that uses an implement and disposable absorbent pad for cleaning, a carpet cleaning concept can be advertised as an extension of this system. With the appropriate product design and instructions for use consumers can get carpets not only cleaned but refreshed quickly and easily without having to use a vacuum cleaner. Spots, spills, and accidents on carpets can also be more easily cleaned up because the consumer can do it standing up rather than having to get down on their hands and knees as they most often do. For refreshing and deodorizing, the consumer can be provided with a different liquid product and a thinner less absorbent pad whereby liquid is misted over the surface and then spread uniformly with the pad.

One skilled in the art will understand that each of the above described adapter plates can be part of a cleaning kit comprising the an adapter plate, at least one cleaning sheet or pad. A kit comprising at least one cleaning pad can also comprise a liquid delivery system such as a hand held sprayer or an aerosol container for spraying a liquid onto a surface to be cleaned.

In one aspect, the present invention is used in combination with hard surface cleaning compositions, preferably for use with the cleaning pads and/or cleaning implements described herein, comprising:

(a) optionally, from about 0.001% to about 0.5% by weight of the composition of surfactant, preferably selected from the group consisting of alkylpolysaccharides, alkyl ethoxylates, alkyl sulfonates, and mixtures thereof;

(b) optionally, hydrophilic polymer, preferably less than about 0.5% by weight of the composition;

(c) optionally, organic solvent, preferably from about 0.25% to about 7% by weight of the composition and preferably having a boiling point of from about 120° C. to about 180° C.;

(d) optionally, from about 0.01% to about 1% by weight of the composition of mono- or polycarboxylic acid;

(e) optionally, from about 0.01% to about 1% by weight of the composition of odor control agent, preferably cyclodextrin;

(f) optionally, a source of peroxide, preferably from about 0.05% to about 5% by weight of the composition and preferably selected from the group consisting of benzoyl peroxide, hydrogen peroxide, and mixtures thereof;

(g) optionally, from about 0.001% to about 0.1% by weight of the composition of thickening polymer;

(h) aqueous solvent system, preferably at least about 80% by weight of the composition;

(i) optionally, suds suppressor;

(j) optionally, from about 0.005% to about 0.2% by weight of the composition of a perfume comprising:

(i) optionally, from about 0.05% to about 90% by weight of the perfume of volatile, hydrophilic perfume material;

(ii) optionally, at least about 0.2% by weight of the perfume of volatile, hydrophobic perfume material;

(iii) optionally, less than about 10% by weight of the perfume of residual, hydrophilic perfume material;

(iv) less than about 10% by weight of the perfume of residual, hydrophobic perfume material;

(k) optionally, a detergent adjuvant, preferably selected from the group consisting of detergency builder, buffer, preservative, antibacterial agent, colorant, bleaching agents, chelants, enzymes, hydrotropes, corrosion inhibitors, and mixtures thereof.

In one embodiment, the present invention is used in combination with a cleaning pad, preferably disposable, for cleaning a hard surface, the cleaning pad comprising:

(a) at least one absorbent layer;

(b) optionally, a liquid pervious scrubbing layer; wherein the liquid pervious scrubbing layer is preferably an apertured formed film, more preferably a macroscopically expanded three-dimensional plastic web, having tapered or funnel-shaped apertures, meaning that the diameter at the lower end of the aperture is greater than the diameter at the upper end of the aperture, actually exhibits a suctioning effect as the cleaning pad is moved across the surface being cleaned, and/or surface aberrations and preferably comprising a hydrophobic material;

(c) optionally, an attachment layer, wherein the attachment layer preferably comprises a clear or translucent material, more preferably a clear or translucent polyethylene film, and wherein the attachment layer preferably comprises loop and/or hook material for attachment to a support head of a handle of a cleaning implement;

(d) optionally, multiple planar surfaces;

(e) optionally, at least one functional cuff, preferably at least one free-floating, looped functional cuff;

(f) optionally, a density gradient throughout at least one absorbent layer; wherein the density gradient preferably comprises a first absorbent layer having a density of from about 0.01 g/cm$^3$ to about 0.15 g/cm$^3$, preferably from about 0.03 g/cm$^3$ to about 0.1 g/cm$^3$, and more preferably from about 0.04 g/cm$^3$ to about 0.06 g/cm$^3$, and a second absorbent layer having a density of from about 0.04 g/cm$^3$ to about 0.2 g/cm$^3$, preferably from about 0.1 g/cm$^3$ to about 0.2 g/cm$^3$, and more preferably from about 0.12 g/cm$^3$ to about 0.17 g/cm$^3$; wherein the density of the first absorbent layer is about 0.04 g/cm$^3$, preferably about 0.07 g/cm$^3$, and more preferably about 0.1 g/cm$^3$, less than the density of the second absorbent layer;

(g) optionally, at least one adhesive scrubbing strap, preferably comprising a material selected from the group consisting of nylon, polyester, polypropylene, abrasive material, and mixtures thereof; and (h) optionally, perfume carrier complex, preferably selected from the group consisting of cyclodextrin inclusion complex, matrix perfume microcapsules, and mixtures thereof; wherein the perfume carrier complex is preferably located in an absorbent layer.

In one aspect of the invention, the adapter plate and cleaning implement are used in combination with a cleaning pad comprising at least two absorbent layers, wherein the absorbent layers have multiple widths in the z-dimension and comprises functional cuffs, preferably free-floating, double-layer loop functional cuffs. Preferably, the cleaning pad has a $t_{1200}$ absorbent capacity of at least about 5 grams/gram.

In another aspect, the adapter plate and cleaning implement are used in combination with a dry cleaning sheet, preferably disposable, for cleaning hard surfaces, the cleaning sheet optionally comprising functional cuffs, preferably free-floating, double-layer loop functional cuffs. Preferred sheets which are suitable for use with the present invention are more fully described in U.S. patent application Ser. No. 09/082,349 entitled "Novel Structures Useful As Cleaning Sheets", filed May 20, 1998; and Ser. No. 09/082,396 entitled "Novel Three Dimensional Structures Useful As Cleaning Sheets", filed May 20, 1998, both of which are hereby incorporated herein by reference. The sheets described in these applications preferably comprise two components: a polymeric net or scrim and a fibrous material which is laid upon the scrim, by lamination via heat or chemical means such as adhesives or by hydrogentanglement. Scrim materials useful herein are described in detail in U.S. Pat. No. 4,636,419, which is incorporated by reference herein. The scrims may be formed directly at the extrusion die or can be derived from extruded films by fibrillation or by embossment, followed by stretching and splitting. The scrim may be derived from a polyolefin such as polyethylene or polypropylene, copolymers thereof, poly(butylene terephthalate), polyethylene terephthalate, nylon 6, nylon 66, and the like. Scrim materials are available from various commercial sources. A preferred scrim material useful in the present invention is a polypropylene scrim, available from Conwed Plastics of Minneapolis, Minn.

The sheets also preferably have a continuous high and discrete low basis weight regions, respectively, and/or a three-dimensional surface, both features being more fully described in U.S. patent application Ser. Nos. 09/082,349 and 09/082,396. While the low basis weight regions are depicted as being of essentially the same size and of a single well defined shape, these regions may be of differing sizes to facilitate entrapment of particles of varying size and shape. The high and low basis weight regions and the three dimensionality of the surface of the sheet assist in receiving and trapping material, such as dust and dirt, in the sheet.

The sheets can be made using either a woven or nonwoven process, or by forming operations using melted materials laid down on forms, especially in belts, and/or by forming operations involving mechanical actions/modifications carried out on films. The structures are made by any number of methods (e.g., spunbonded, meltblown, resin bonded, air-through bonded, etc.), once the essential three dimensional and basis weight requirements are known. However, the preferred structures are nonwoven, and are especially those formed by hydroentanglement as is well known in the art, since they provide highly desirable open structures. Also preferred are heat-bonded nonwoven structures which utilize continuous filaments bonded to a base sheet via heat-sealed lines.

Materials particularly suitable for forming the fibrous material of the sheet include, for example, natural cellulosics as well as synthetics such as polyolefins (e.g., polyethylene and polypropylene), polyesters, polyamides, synthetic cellulosics (e.g., RAYON®), and blends thereof. Also useful are natural fibers, such as cotton or blends thereof and those derived from various cellulosic sources. Preferred starting materials for making the hydroentangled fibrous sheets of the present invention are synthetic materials, which may be in the form of carded, spunbonded, meltblown, airlaid, or other structures. Particularly preferred are polyesters, especially carded polyester fibers. The degree of hydrophobicity or hydrophilicity of the fibers is optimized depending upon the desired goal of the sheet, either in terms of type of soil to be removed, the type of additive that is provided, when an additive is present, biodegradability, availability, and combinations of such considerations. In general, the more biodegradable materials are hydrophilic, but the more effective materials tend to be hydrophobic.

During the effort to develop the present cleaning pads and sheets, Applicants discovered that an important aspect of cleaning performance is related to the ability to provide a cleaning pad having apertured formed films, a liquid impervious attachment layer, and/or density gradients, and/or functional cuffs and a cleaning sheet having functional cuffs. In the context of a typical cleaning operation (i.e., where the cleaning pad and/or sheet is moved back and forth in a direction substantially parallel to the pad's or sheet's y-dimension or width), each of these structural elements provide the cleaning pads and/or sheets improved cleaning performance, both separately and in combination with one or more additional elements. Apertured formed films, preferably utilized in the scrubbing layer, are pervious to liquids and provide efficient transfer of liquid from the surface being cleaned to other layers of the cleaning pad, preferably one or more absorbent layers, while reducing the tendency for such liquid to be squeezed back onto the surface being cleaned. Functional cuffs are preferably free-floating so as to "flip" back and forth in the y-dimension during a typical cleaning operation, thus trapping particulate matter and reducing the tendency for such particulate matter to be redeposited on the surface being cleaned. Density gradients are preferably incorporated in the absorbent layer(s) of the cleaning pad to "pump" or "wick" liquid away from the surface being cleaned to areas in the cleaning pad furthest away from the surface being cleaned. The liquid impervious attachment layer provides a barrier which helps to better distribute the liquid in the x-y direction after liquid reaches the back of the pad which is further set away from the cleaning surface. These aspects of the present invention, and the benefits provided, are discussed in detail with reference to the drawings.

The skilled artisan will recognize that various materials can be utilized to carry out the claimed invention. Thus, while preferred materials are described below for the various adapter plates, cleaning implement, pad, and sheet components, it is recognized that the scope of the invention is not limited to such descriptions.

It has been found that incorporating a density gradient throughout the absorbent layer(s) of the cleaning pad used in combination with the adapter plates of the present invention has an important effect on cleaning performance and ability of the cleaning pad to quickly absorb liquids, especially liquid containing particulate matter. Although density gradients have been used in absorbent articles such as diapers, sanitary napkins, incontinence devices, and the like, Applicants have discovered specific density gradients optimally useful for the absorbent layer in cleaning pads. Density gradients in cleaning pads are unique for at least two identifiable reasons. First, the absorbent layer in a cleaning pad needs to handle liquid with both dissolved components and undissolved, suspended components, such as insoluble particulate matter. In the case of diapers, sanitary napkins, incontinence devices, and the like, the absorbent layer typically needs to handle only liquids with dissolved components, such as bodily fluids. Second, the absorbent layer of a cleaning pad needs to absorb liquid against the force of gravity. In terms of diapers, sanitary napkins, incontinence devices, and the like, the absorbent layer typically has the force of gravity to pull liquid into, and distribute it throughout, the absorbent layer. Having sufficient resiliency in the cleaning pad is important, as described below, in maintaining good cleaning performance, especially in cleaning pads comprising a density gradient. The preferred cleaning pads comprising the specific density gradients described herein exhibit improvements in at least three important characteristics affecting hard surface cleaning performance: acquisition (the time required to transfer liquid from the surface being cleaned to the absorbent layer(s) of the cleaning pad), distribution (the liquid wicking ability of the absorbent layer(s) so as to utilize as much of the pad as possible), and rewet (the amount of dirty liquid retained within the absorbent layer(s) and not squeezed out during a cleaning process).

The absorbent layer can comprise a single absorbent layer with a continuous density gradient in the cleaning pad's z-dimension, or multiple absorbent layers having different densities resulting in a density gradient. A continuous density gradient is one in which the material comprising the cleaning pad is homogeneous, but has differing densities throughout the material. A process for creating a continuous density gradient is disclosed in U.S. Pat. No. 4,818,315, issued Apr. 4, 1989 to Hellgren, et al., which is hereby incorporated by reference. The density of the dry web used to form the layers of the pad can be measured after evaporating the liquid from the premoistened wipe. The density is the basis weight of the dry web divided by the thickness of the dry web, measured in consistent units, and the thickness of the dry web is measured using a circular load foot having an area of about 2 square inches and which provides a confining pressure of about 95 grams per square inch. Preferably, the cleaning pad used in combination with the present invention comprises a density gradient resulting from multiple absorbent layers, preferably three, each having a different density. A density gradient is typically "strong" when the density of the absorbent layers increase from a lower absorbent layer to an upper absorbent layer. Preferably, the present cleaning pads comprise a "strong" density gradient, which provides fast acquisition, better core utilization by effectively wicking liquid in the z- and x-y directions, and a reduced tendency for allowing absorbed liquids, especially those containing undissolved particulate, to be squeezed out. A strong density gradient preferably comprises at least two absorbent layers, with a first absorbent layer having a density of from about 0.01 g/cm$^3$ to about 0.15 g/cm$^3$, preferably from about 0.03 g/cm$^3$ to about 0.1 g/cm$^3$, and more preferably from about 0.04 g/cm$^3$ to about 0.06 g/cm$^3$, and a second absorbent layer having a density of from about 0.04 g/cm$^3$ to about 0.2 g/cm$^3$, preferably from about 0.1 g/cm$^3$ to about 0.2 g/cm$^3$, and more preferably from about 0.12 g/cm$^3$ to about 0.17 g/cm$^3$; wherein the density of the first absorbent layer is about 0.04 g/cm$^3$, preferably about 0.07 g/cm$^3$, and more preferably about 0.1 g/cm$^3$, less than the density of the second absorbent layer.

In another embodiment, the present cleaning pad comprises a density gradient resulting from three absorbent layers, wherein a first absorbent layer has a density of from about 0.01 g/cm$^3$ to about 0.08 g/cm$^3$, preferably from about 0.03 g/cm$^3$ to about 0.06 g/cm$^3$, and a second absorbent layer has a density of from about 0.03 g/cm$^3$ to about 0.12 g/cm$^3$, preferably from about 0.07 g/cm$^3$ to about 0.1 g/cm$^3$, and a third absorbent layer has a density of from about 0.05 g/cm$^3$ to about 0.2 g/cm$^3$, preferably from about 0.08 g/cm$^3$ to about 0.15 g/cm$^3$; wherein the difference in density between the first absorbent layer and the second absorbent layer, and between the second absorbent layer and the third absorbent layer, is at least about 0.02 g/cm$^3$, preferably at least about 0.04 g/cm$^3$.

In yet another embodiment, the cleaning pad comprises a first absorbent layer having a density of about 0.05 g/cm$^3$, a second absorbent layer having a density of about 0.1 g/cm$^3$, and a third absorbent layer having a density of about 0.15 g/cm$^3$. It is recognized that a such a density gradient can be present in a cleaning pad with or without layers having multiple widths in the z-dimension.

As a result of the density gradient, the porosity (meaning the ratio of the volume of interstices of a material to the total volume) of the absorbent layer will typically decrease as the density increases. The porosity is important, particularly in the context of a cleaning pad for cleaning hard surfaces, because the liquid to be absorbed by the cleaning pad typically contains moderate amounts of relatively large particulate matter. As the soiled liquid enters the cleaning pad through the scrubbing layer, the larger particulate matter becomes entrapped in the interstices of the lower absorbent layers. As the porosity of the absorbent layers decreases, and the density increases, the larger particulate matter becomes trapped in the larger interstices of the lower absorbent layers and the remaining liquid is then transferred to the upper absorbent layers. This allows the liquid to be more easily transferred towards the higher-density layers and allows the particulate matter to remain trapped in the interstices of the lower absorbent layers. As a result, the cleaning pad retains both liquid and particulate matter much more effectively than cleaning pads without a strong density gradient.

Where an absorbent layer has a density of less than about 0.1 g/cm$^3$, the layer tends to be less resilient, which is another important property of the present cleaning pad as discussed below. In order to increase the resiliency of an absorbent layer having a relatively low density, a thermoplastic material, preferably a bicomponent fiber, is combined with the fibers of the absorbent layer. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or web of fibers together in each of the respective layers. This can be beneficial in providing additional overall integrity to the cleaning pad. While bicomponent fibers are known in the art, they are typically used at levels of less than about 15%. It has been found that in order to provide desired resiliency, an absorbent layer having a density of less than about 0.05 g/cm$^3$ preferably comprises at least about 20%, preferably at least about 30%, more preferably at least about 40%, of a thermoplastic material such as a bicomponent fiber. A preferable bicomponent fiber comprises a copolyolefin bicomponent fiber comprising less than about 81% polyethylene terphthalate core and less than about 51% copolyolefin sheath and is commercially available from the Hoechst Celanese Corporation under the tradename CELBOND® T-255.

The foregoing description of the preferred embodiments of the invention have been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto.

What we claim is:

1. An cleaning implement comprising:

a) a cleaning implement comprising a handle pivotably connected to a mop head, said mop head comprising securing members capable of removably attaching an adapter plate and a fluid container in fluid communication with a nozzle located on said mop head;

b) an adapter plate having a top and a bottom surface, a leading and a trailing edge, said adapter plate comprising at least one securing element capable of removably securing a cleaning pad or a cleaning sheet to said adapter plate, and wherein said adapter plate is removably attached to said mop head.

2. The cleaning implement of claim 1 wherein said securing members are male fasteners located at the bottom of said mop head and female fasteners located on the top surface of said adapter plate.

3. The cleaning implement of claim 2 further comprising a cleaning pad having a top and a bottom surface.

4. The cleaning implement of claim 3 wherein said at least one securing element comprises male fasteners located on the bottom surface of said adapter plate and female fasteners located on the top surface of said cleaning pad.

5. The cleaning implement of claim 4 wherein the bottom surface of said adapter plate comprises discontinuities for generating pressure zones about the extremities of said pad during a forward and backward wiping motion of said cleaning implement on a surface to be cleaned.

6. The cleaning implement of claim 5 wherein said discontinuities are created by at least a first and a second elevational element, said first elevational element is located about one extremity of said adapter plate relative its length and said second elevational element is located about the opposite extremity of said adapter plate such that a hollow space is defined between said first and second elevational elements and a centered portion of the bottom surface of said adapter plate.

7. The cleaning implement of claim 6 wherein said adapter plate is flexible such that when pressure is applied to said centered portion of said adapter plate, said centered portion at least partially collapses and fills at least partially said hollow space.

8. The cleaning implement of claim 7 wherein said adapter plate comprises a substantially centered elevational element relative to the width of said adapter plate at the bottom surface of said plate and extending at least partially along the length of said plate and wherein said centered elevational element generates a pressure zone about the centered portion of said pad during a forward and backward wiping motion of said cleaning implement.

9. The cleaning implement of claim 4 wherein said adapter plate further comprises at least one scrubbing element pivotably attached to one edge of said adapter plate.

10. The cleaning implement of claim 9 wherein said scrubbing element is pivotably attached to said trailing edge of said adapter plate.

11. The cleaning implement of claim 10 wherein said adapter plate further comprises a squeegee element pivotably attached to one edge of said adapter plate.

12. The cleaning implement of claim 2 wherein said adapter plate is at least about 50% longer than said mop head.

13. The cleaning implement of claim 12 wherein said adapter plate is up to about 150% longer than said mop head.

14. The cleaning implement of claim 2 wherein said adapter plate is up to about 50% wider than said mop head.

15. The cleaning implement of claim 2 further comprising a cleaning sheet.

16. The cleaning implement of claim 15 wherein said at least one securing element comprises an attachment structure located on the top surface of said adapter plate wherein said attachment structure is made of a flexible material and further comprises a base triangle having an apex and a plurality of substantially pie-shaped sections whose apexes meet at a substantially common point adjacent said base triangle and whose apexes are distinct from said base triangle's apex, wherein two sides of each of said base triangle and said pie-shaped sections are defined by slits passing through said flexible material such that each of said base triangle and said pie-shaped sections can be deflected to receive the sheet and wherein each of said silts terminates at one end with a substantially circular opening.

17. The cleaning implement of claim 15 wherein said adapter plate further comprises at least one side panel extending from one edge of said adapter plate, said side panel being angled relative said adapter plate.

18. The cleaning implement of claim 17 wherein said adapter plate comprises a first and a second side panel, said first side panel extends from said leading edge and said second side panel extends from said trailing edge, and four attachment structures wherein each attachment structure is respectively positioned about each corners of said first and second side panels.

19. An adapter plate for a cleaning implement having a handle and a mop head comprising:

a plate having a top and a bottom surface, said plate comprising at least one securing element capable of removably securing a cleaning pad or a cleaning sheet to said plate, and wherein said plate comprises securing members capable of removably attaching said plate to said mop head of a cleaning implement, wherein said securing members are male fasteners located at the bottom of said mop head and female fasteners located on the top surface of said plate.

20. The adapter plate of claim 19 wherein said securing element comprises male fasteners located on the bottom surface of said plate and female fasteners located on the top surface of said cleaning pad.

21. The adapter plate of claim 20 wherein the bottom surface of said plate comprises discontinuities capable of generating pressure zones about the extremities of said pad during a forward and backward wiping motion of said cleaning implement on a surface to be cleaned.

22. The adapter plate of claim 21 wherein said discontinuities are created by at least a first and a second elevational element, said first elevational element is located about one extremity of said plate relative its length and said second elevational element is located about the opposite extremity of said plate such that a hollow space is defined between said first and second elevational elements and a centered portion of the bottom surface of said plate.

23. The adapter plate of claim 22 wherein said plate is flexible such that when pressure is applied to said centered portion of said plate, said centered portion at least partially collapses and fills at least partially said hollow space.

24. The adapter plate of claim 23 wherein said adapter plate comprises a substantially centered elevational element relative to the width of said plate at the bottom surface of said plate and extending at least partially along the length of said plate and wherein said centered elevational element is capable of generating a pressure zone about the centered portion of said pad during a forward and backward wiping motion of said cleaning implement.

25. The adapter plate of claim 20 wherein said plate further comprises at least one scrubbing element pivotably attached to one edge of said adapter plate.

26. The adapter plate of claim 25 wherein said scrubbing element is pivotably attached to said trailing edge of said adapter plate.

27. The adapter plate of claim 26 wherein said plate further comprises a squeegee element pivotably attached to one edge of said plate.

28. The adapter plate of claim 19 wherein said plate is at least about 50% longer than said mop head.

29. The adapter plate of claim 23 wherein said plate is up to about 150% longer than said mop head.

30. The adapter plate of claim 19 wherein said plate is up to about 50% wider than said mop head.

31. The adapter plate of claim 19 further comprising a cleaning sheet.

32. The adapter plate of claim 31 wherein said at least one securing element comprises an attachment structure located on the top surface of said adapter plate wherein said attachment structure is made of a flexible material and further comprises a base triangle having an apex and a plurality of substantially pie-shaped sections whose apexes meet at a substantially common point adjacent said base triangle and whose apexes are distinct from said base triangle's apex, wherein two sides of each of said base triangle and said pie-shaped sections are defined by slits passing through said flexible material such that each of said base triangle and said pie-shaped sections can be deflected to receive the sheet and wherein each of said slits terminates at one end with a substantially circular opening.

33. The adapter plate of claim 32 wherein said plate comprises four attachment structures positioned about the four corners of said adapter plate.

34. The adapter plate of claim 32 wherein said plate further comprises at least one side and extending from one edge of said adapter plate, said side panel being angled relative said adapter plate.

35. The adapter plate of claim 34 wherein said plate comprises a first and a second side panel, said first side panel extends from said leading edge and said second side panel extends from said trailing edge, and four attachment structures wherein each attachment structure is respectively positioned about each corners of said first and second side panels.

36. A cleaning kit for use with a dry cleaning implement comprising:

an adapter plate having a top and a bottom surface, a leading and a trailing edge said adapter plate comprising at least one securing element capable of removably securing a cleaning pad to said adapter plate and a securing member for removably securing said adapter plate to a dry cleaning implement;

a liquid delivery mechanism; and at least one cleaning pad.

37. The cleaning kit of claim 36 wherein said liquid delivery mechanism is a hand held sprayer.

38. A cleaning kit for use with a wet cleaning implement comprising:

an adapter plate having a top and a bottom surface, a leading and a trailing edge, said adapter plate comprising at least one securing element capable of removably securing a cleaning sheet to said adapter plate and a securing member for removably securing said adapter plate to a wet cleaning implement, wherein said securing member is female fasteners located on the top surface of said plate; and at least one cleaning sheet.

* * * * *